US007132207B2

(12) United States Patent
Nonaka et al.

(10) Patent No.: US 7,132,207 B2
(45) Date of Patent: Nov. 7, 2006

(54) TONER KIT AND COLOR-IMAGE-FORMING METHOD

(75) Inventors: Katsuyuki Nonaka, Ibaraki (JP); Yushi Mikuriya, Shizuoka (JP); Shinya Yachi, Shizuoka (JP); Shuntaro Watanabe, Shizuoka (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 11/303,678

(22) Filed: Dec. 16, 2005

(65) Prior Publication Data

US 2006/0093930 A1 May 4, 2006

Related U.S. Application Data

(63) Continuation of application No. 10/676,805, filed on Oct. 1, 2003, now Pat. No. 7,029,809.

(30) Foreign Application Priority Data

Oct. 2, 2002 (JP) ..... 2002-290527

(51) Int. Cl.
*G03G 15/01* (2006.01)

(52) U.S. Cl. ..... 430/45; 430/107.1; 430/108.1; 430/110.4; 430/111.4

(58) Field of Classification Search ..... 430/45, 430/107.11, 110.4, 12.6, 107.1, 108.1, 111.4
See application file for complete search history.

(56) References Cited

U.S. PATENT DOCUMENTS 6,316,157 B1 11/2001 Yoshikawa et al.
6,855,469 B1 2/2005 Ikeda et al.

*Primary Examiner*—John L Goodrow
(74) *Attorney, Agent, or Firm*—Rossi, Kimms & McDowell, LLP

(57) ABSTRACT

In a toner kit having i) a non-magnetic black toner having at least carbon black and ii) color toners, the black toner has a weight-average particle diameter represented by D4*b* and a one-point method BET specific surface area represented by Sb, and the color toners, other than the-black toner, each have a weight-average particle diameter represented by D4*c* and a one-point method BET specific surface area represented by Sc, where the black toner and color toners satisfy the following relations (1) and (2):

$$0.60 \leqq D4.c/D4b \leqq 0.96,: \quad \text{Relation (1)}$$

$$0.750 \leqq Sc/Sb \leqq 1.000;: \quad \text{Relation (2)}$$

and each have an average circularity of from 0.950 to 1.000 and a circularity standard deviation of less than 0.040 as measured with a flow type particle image analyzer.

20 Claims, 6 Drawing Sheets

TONER KIT AND COLOR-IMAGE-FORMING METHOD

This is a continuation of application Ser. No. 10/676,805, filed Oct. 1, 2003, now U.S. Pat. No. 7,029,809.

BACKGROUND OF THE INVENTION

1. Field of the Invention

This invention relates to a toner kit and an image-forming method which are used in image-forming apparatus such as electrophotographic apparatus and printers of an elect rephotograph system or electrostatic recording system in which a developer is made to adhere to an electrostatically charged image (latent image) formed on an image-bearing member, rendering the image visible.

2. Related Background Art

Full-color image formation by electrophotography is basically made by combination of a yellow toner, a magenta toner and a cyan toner and optionally a black toner (see, e.g., Japanese Patent Publication No. S53-47176). Then, a full-color copied image is formed by sequentially superimposing three color toners, or four color toners inclusive of a black toner, on a transfer paper, where not only developing performance but also transfer performance are important factors that determine image quality.

In recent years, with wide spread of image-forming apparatus such as full-color copying machines and color laser printers, they also have become used in various purposes, and have come severely required on image quality. For example, in the copying of images such as catalogues and maps, it is demanded to reproduce images very finely and faithfully without crushing or breaking, up to fine details. Also, in image-forming apparatus such as color laser printers making use of digital image signals, latent images are formed by collection of dots with a stated potential, and solid areas, halftone areas and light areas are expressed by change of the area of each dot. In order to achieve high image quality, it is increasingly highly needed to perform not only faithful development of these images but also faithful transfer of developed images.

Electrical resistance of toners can be given as a physical property that has great influence on such transfer. A difference between a high-resistance organic colorant added internally to each color toner and low-resistance carbon black added internally to a black toner causes a difference in their transfer performance. This is a problem always present in full-color image formation. In order to solve the problem on transfer at the time of full-color image formation, a measure is taken by, e.g., making different the amount of fine particles added to a toner base (toner particles) for each station of an image-forming apparatus (e.g., see Japanese Patent Application Laid-Open No. H02-284159), or making the shape of toner particles different by colors (e.g., see Japanese Patent Application Laid-Open No. H11-295931). There is further a proposal that, in an image-forming apparatus having a specific structure, the amount of a fluidity improver added to a black toner base (black toner particles) is made smaller than the amount of a fluidity improver added to each color toner base (color toner particles) to uniform the degree of agglomeration between the black toner and each color toner so that the charging performance can be made stable during running (e.g., see Japanese Patent Application Laid-Open No. 2000-267443.

However, as apparatus are made highly functional, situations are coming in which transfer performance must be much more improved than ever. For example, recently, it is becoming ordinary for the apparatus to be furnished with the function of double-side printing, and it has come demanded to provide an image-forming method which can simply and sufficiently deal with a difference in transfer performance between the first-side printing and the second-side printing in a high-temperature and high-humidity environment that makes designing difficult. Besides, in machines which can print images on a variety of recording mediums but have a secondary transfer mechanism which more tends to cause image deterioration because transfer is performed twice, it has come demanded to faithfully transfer full-color images to transfer materials. Further, there is a high desire to lessen wastes as far as possible. Accordingly, it has come desired to more improve transfer efficiency.

SUMMARY OF THE INVENTION

Taking account of such circumstances, an object of the present invention is to provide a toner kit and an image-forming method which enable adaptation to transfer to various recording mediums.

Another object of the present invention is to provide a toner kit and an image-forming method which enable restraint of problems such as toner scatter (sports around line images) and coarse images from occurring, maintaining a high transfer efficiency even in a high-temperature and high-humidity environment.

The above objects are achieved by the invention described below.

That is, the above objects are achieved by a toner kit comprising a non-magnetic black toner having at least carbon black, and at least three color toners;

the black toner having a weight-average particle diameter represented by D4b and a one-point method BET specific surface area represented by Sb, and the color toners, other than the black toner, each having a weight-average particle diameter represented by D4*c* and a one-point method BET specific surface area represented by Sc, where;

the black toner and color toners satisfy the following relations (1) and (2):

$$0.60 \leqq D4c/D4b \leqq 0.96, \quad \text{Relation (1):}$$

$$0.750 \leqq Sc/Sb < 1.000; \quad \text{Relation (2):}$$

and each have an average circularity of from 0.950 to 1.000 and a circularity standard deviation of less than 0.040 as measured with a flow type particle image analyzer.

The above objects are also achieved by a color image-forming method comprising:

a charging step of electrostatically charging an electrostatic-latent-image-bearing member for holding thereon an electrostatic latent image;

an electrostatic latent image formation step of forming the electrostatic latent image on the electrostatic-latent-image-bearing member thus charged;

a developing step of developing the electrostatic latent image by the use of a toner a developing means has, to form a toner image;

a transfer step of transferring the toner image held on the electrostatic-latent-image-bearing member, to a transfer material via, or not via, an intermediate transfer member; and a fixing step of fixing by a fixing means the toner image held on the transfer material;

i) a non-magnetic black toner having at least carbon black and ii) at least three color toners each being used as the toner;

the black toner having a weight-average particle diameter represented by D4*b* and a one-point method BET specific surface area represented by Sb, and the color toners, other than the black toner, each having a weight-average particle diameter represented by D4*c* and a one-point method BET specific surface area represented by Sc, where;

the black toner and color toners satisfy the following relations (1) and (2):

$$0.60 \leqq D4c/D4b \leqq 0.96, \quad \text{Relation (1):}$$

$$0.750 \leqq Sc/Sb \leqq 1.000; \quad \text{Relation (2):}$$

and each have an average circularity of from 0.950 to 1.000 and a circularity standard deviation of less than 0.040 as measured with a flow type particle image analyzer.

DESCRIPTION OF THE PREFERRED EMBODIMENTS

Figure 1:
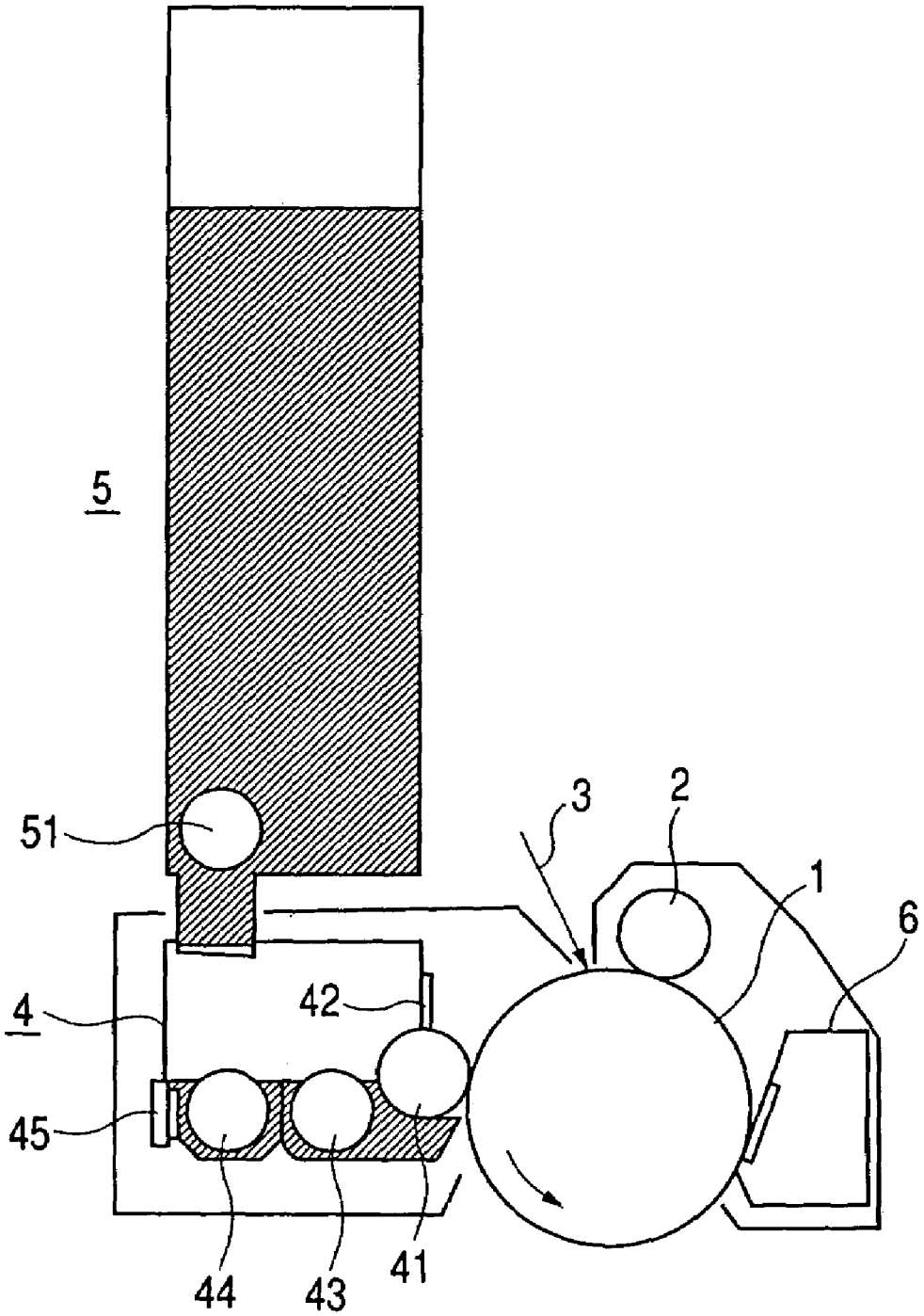
FIG. 1 illustrates an image-forming method to which the present invention is applicable.

The present invention concerns a toner kit and an image-forming method which are used in color image formation methods and make use of a non-magnetic black toner having at least carbon black, and at least three color toners. The present invention is characterized in that the black toner has a weight-average particle diameter represented by D4*b* and a one-point method BET specific surface area represented by Sb, and the color toners each have a weight-average particle diameter represented by D4*c* and a one-point method BET specific surface area represented by Sc, where the black toner and color toners satisfy the following relations (1) and (2):

$$0.60 \leqq D4c/D4b \leqq 0.96, \quad \text{Relation (1):}$$

$$0.750 \leqq Sc/Sb \leqq 1.000; \quad \text{Relation (2):}$$

and each have an average circularity of from 0.950 to 1.000 and a circularity standard deviation of less than 0.040 as measured with a flow type particle image analyzer.

As a result of studies made by the present inventors, it has emerged that the satisfaction of such relations brings various effects such as improvement in transfer efficiency, harmonization between the black toner and the color toners, and exclusion of any influence of the electrical resistance of transfer materials. In particular, in comparison with conventional cases, the secondary transfer efficiency of multiple color image containing the black toner in a high-temperature and high-humidity environment is remarkably improved. In addition thereto, also brought is the effect of broadening proper regions of transfer current. Even in an image-forming method having no secondary transfer, there is an effect that the black toner to be transferred onto color toner images is prevented from scattering. This also is considered to be what comes from the harmonization of charging performance and transfer performance of the color toners and black toner.

The relations (1) and (2) define that, although the black toner has a larger particle diameter than the color toners, the BET specific surface area of the black toner is equal to, or larger than, the BET specific surface area of each color toner.

Regulating the particle diameters of the black toner and color toners in such a way that they satisfy the relation (1): $0.60 \leqq D4c/D4b \leqq 0.96$ makes it possible to make the contact opportunities and contact area of the black toner (incorporated with low-resistance carbon black) smaller than those of the color toners, and to appropriately keep electric charges from leaking from the black toner. This enables improvement in secondary transfer efficiency. In the present invention, it is particularly preferable to satisfy the relation of $0.78 \leqq D4c/D4b \leqq 0.94$.

Regulating the BET specific surface area of the black toner and color toners in such a way that they satisfy the relation (2): $0.750 \leqq Sc/Sb \leqq 1.000$ optimizes charge retentivity of the black toner and matches transfer performance of the color toners with that of the black toner. In the present invention, it is particularly preferable to satisfy the relation of $0.850 \leqq Sc/Sb \leqq 0.990$.

Further fulfilling the conditions that the toners each have an average circularity of from 0.950 to 1.000 and a circularity standard deviation of less than 0.040 brings more improvement in transfer efficiency, makes higher the effect of improving image quality, and brings dramatic improvement in color image quality on various transfer mediums (recording mediums). In the present invention, it is more preferable that the toners each have an average circularity of from 0.970 to 1.000 and a circularity standard deviation of less than 0.035. In regard to the color toners, it is preferable that they each have an average circularity of from 0.980 to 1.000 and a circularity standard deviation of less than 0.030.

That is, in the present invention, the quantity of leak of electric charges from the black toner is optimized taking account of its relation with the color toners on the basis of the relation (1), and the charge retentivity of the black toner is optimized taking account of its relation with the color toners on the basis of the relation (2), and further the transfer efficiency of each toner is made higher by controlling its average circularity within the stated range. We consider that regulating the black toner and color toners in such a way that they satisfy all of these conditions brings the effect of the present invention, The toners according to the present invention each have, as described above, a particle shape that is close to spheres and is also uniform in circularity distribution. Hence, they are uniform to a certain extent in regard to toner's charging performance as well, and can not easily produce components having been charged in reverse polarity. Such toners tend to have a relatively low degree of agglomeration. Hence, in the case when full-color images are formed, it is more important to uniform charging performances of the respective toners than to uniform the degrees of agglomeration of the black toner and color toners by controlling the degree of agglomeration of the black toner. Accordingly, in the present invention, the black toner and color toners are so regulated that they satisfy the relations (1) and (2), to enable good full-color image formation.

The satisfaction of the relations (1) and (2) also makes the black toner have a smaller area of contact with toner particles themselves or with constituent members and also have a larger BET specific surface area, and hence the black toner can have a high charge retentivity. In addition, the toners according to the present invention have so high circularity as to have particle shapes that are close to spheres, and also they are toners having sharp circularity distribution. Hence, this makes a uniform electrostatic force act on the toners. In virtue of cooperative effect of these, transfer performances of the respective toners can be made uniform, so that the threshold region: of transfer current can be broadened and the designing of transfer mechanism can be made in a broader range. Where images are formed using an intermediate transfer member, although the color toners and the black toner have transfer performances different from one another, the same transfer current is used in order that respective-color toner images superimposed can be transferred to a transfer medium. Hence, it is more strictly required to regulate the transfer performances of the respective toners. However, the use of the toner kit of the present invention enables good full-color image formation in virtue of the above functions. In particular, toners tend to change in electrical resistance in a high-temperature and high-humidity environment, and the respective toners may more differ in transfer performance to make it difficult to perform good transfer. However, in the present invention, good transfer can be performed even when cardboard is used in a high-temperature and high-humidity environment. A remarkable effect of improvement can be seen especially in secondary transfer.

Meanwhile, where images are transferred to a transfer medium only by primary transfer, the effect of preventing toner scatter can be seen especially when the black toner is superimposed on color toner, images. This also is considered to probably come from the fact that the satisfaction of the above conditions has optimized the lines of electric force applied to the toners.

If the value of D4*c*/D4*b* is less than 0.60, a difference in granularity in appearance may come between the color toners and the black toner, and hence the is effect of improvement in transfer performance may be cancelled to tend to result in a lowering of image quality. If the value of D4*c*/D4*b* is more than 0.96, the difference in transfer performance between the color toners and the black toner can not sufficiently be compensated, resulting in a narrow range of the designing of transfer mechanism.

If the value of Sc/Sb is less than 0.750, the transfer current proper regions of the color toners and black toner may shift undesirably. If on the other hand the value of Sc/Sb is more than 1.000, the effect of improving transfer performance in a high-temperature and high-humidity environment may lower to make it difficult to maintain transfer performance on various transfer mediums.

If the black toner and the color toners each have an average circularity of less than 0.950, not only their transfer efficiency may fall, but also a narrow transfer current proper region may result which is on cardboard in a high-temperature and high-humidity environment. For the same reasons, they are also required to have a circularity standard deviation of less than 0.040.

In addition to the above conditions, where the proportion of 5.04 μm or smaller particles that is calculated from number-based particle size distribution of the black toner is represented by $Ub_{5.04}$ (% by number), the proportion of 5.04 μm or smaller particles that is calculated from number-based particle size distribution of each color toner is represented by $Uc_{5.04}$ (% by number), the proportion of 12.7 μm or larger particles that is calculated from weight-based particle size distribution of the black toner is represented by $Ub_{12.7}$ (% by weight), and the proportion of 12.7 μm or larger particles that is calculated from weight-based particle size distribution of each color toner is represented by $Uc_{12.7}$ (% by weight), the toners may preferably satisfy the following relations (3), (4) and (5) simultaneously:

$$1.2 \leqq Uc_{5.04}/Ub_{5.04} \leqq 6.0, \quad \text{Relation (3):}$$

$$Ub_{12.7} \leqq 2.0, \quad \text{Relation (4):}$$

$$Uc_{12.7} \leqq 1.0. \quad \text{Relation (5):}$$

Toners of 5.04 μm or less in particle diameter have, because of a larger specific surface area, a greater influence of particle diameter on charge quantity per unit weight. Therefore, the satisfaction of the relation (3) brings harmonization of charging performances between the color toners and the black toner, further improving transfer performance.

On the other hand, toners having large particle diameters relatively have small charge quantity per unit weight, and hence tend to have influence on coarse images and re-transfer. Therefore, the simultaneous satisfaction of the relations (3), (4) and (5) brings more improvement in image stability in the transfer current proper region.

In the present invention, the toners may more preferably satisfy:

$$1.2 \leqq Uc_{5.04}/Ub_{5.04} \leqq 3.0,$$

$$Ub_{12.7} \leqq 1.2,$$

$$Uc_{12.7} \leqq 0.8;$$

and more preferably:

$$1.2 \leqq Uc_{5.04}/Ub_{5.04} \leqq 3.0,$$

$$Ub_{12.7} \leqq 1.0,$$

$$Uc_{12.7} \leqq 0.5.$$

This can enlarge the transfer current proper region, and can more keep the toners from re-transfer.

As more preferable ranges of toner particle diameters in the present invention, the black toner may have a weight average particle diameter (D4*b*) of from 3.2 μm to 10 μm, and the color toners may each have a weight average particle diameter (D4*c*) of from 3.0 μm to 9.6 μm. If the toners have particle diameters that are larger beyond these ranges, the image quality tends to lower. If on the other hand the toners have particle diameters that are smaller beyond these ranges, electrical control in development and transfer may come difficult.

In the present invention, it is preferable that inorganic fine particles are contained in the toners. In particular, it is more preferable that fine silica particles are contained in the toners. It is further preferable that two or more kinds of inorganic fine particles having different BET specific surface areas are contained in the toners. The inorganic fine particles are added for the purposes of, e.g., providing the toners with fluidity, obtaining the effect of charge retention, and preventing the toners from deteriorating. In addition, it is more preferable that fine silica particles having been subjected to oil treatment are added to the toners, because it brings an improvement in transfer efficiency and makes the toners adaptable to various transfer mediums in a high-temperature and high-humidity environment.

As described previously, the feature that the toners satisfy the relations (1) and (2) shows that the black toner, though having a larger particle diameter than the color toners, has a larger BET specific surface area than the color toners. In order to prepare the toners that can satisfy the relation (1), the black toner may be made to have larger particles than the color toners in regard to toner bases themselves. Then, in order to satisfy the relation (2) while satisfying the relation (1), the following methods are available:

(i) the surfaces of black toner base particles are made to have unevenness;

(ii) a low strength is applied when the inorganic fine particles and the black toner base particles are mixed; and (iii) the inorganic fine particles are added in a large quantity to black toner base particles, or inorganic fine particles having a larger BET specific surface area are added to black toner particles, to make large the total BET specific surface area of the inorganic fine particles added to the black toner particles. In particular, the method (iii) is preferred because the transfer performance in a high-temperature and high-humidity environment is well maintained also after printing on a large number of sheets.

The toner kit of the present invention may preferably be used in an image-forming method in which a black-image formation unit having at least an electrostatic-latent-image-bearing member, a charging means, a developing means and a toner-carrying means is used to form a black toner image and also color-image formation units each having at least an electrostatic-latent-image-bearing member, a charging means, a developing means and a toner-carrying means are used to form color toner images, and in which the black-image formation unit and color-image formation units are disposed in a tandem form. In particular, the effect of the present invention can greatly be brought out in an image-forming method making use of an intermediate transfer member. The toner kit of the present invention may also preferably be used in an image-forming method in which after toner images formed on an electrostatic-latent-image-bearing member have been transferred, transfer residual toners remaining on the electrostatic-latent-image-bearing member are collected in the step of development, where the transfer performance can be kept from deteriorating. Further, the use of the toner kit of the present invention brings harmonization of charging performances of the color toners and black toner, and this is also effective in minimizing any ill effects of the inclusion of different-color toner(s) that is caused by re-transfer.

The toner kit of the present invention is suited for a developing system (auto-refresh developing system) which is a two-component developing system having a developing step of performing development making use of a two-component developer containing a non-magnetic toner and a magnetic carrier, and in which images are formed collecting the carrier successively and replenishing a replenishing developer containing the non-magnetic toner and the magnetic carrier. This is because the long-term stability is set off by the present invention. For example, even in abrupt replenishment of developers when printing in a high print percentage is performed after printing in a low print percentage has continued, variations in charge quantity can be controlled by keeping toners from deteriorating, to prevent the charging performance from changing abruptly.

In the present invention, the average particle diameter of each toner is measured with a Coulter counter. As a specific measuring instrument, a Coulter counter Model TA-II or Coulter Multisizer (both manufactured by Coulter Electronics, Inc.) may be used. As an electrolytic solution, an aqueous about 1% NaCl solution is prepared using first-grade sodium chloride. For example, ISOTON R-II (trade name; manufactured by Coulter Scientific Japan Co.) may be used. Measurement is carried out by adding as a dispersant 0.1 to 5 ml of a surface active agent, preferably an alkylbenzene sulfonate, to 100 to 150 ml of the above electrolytic solution, and further adding 2 to 20 mg of a sample to be measured. The electrolytic solution to which the measuring sample has been suspended is subjected to dispersion for about 1 minute to about 3 minutes in an ultrasonic dispersion machine. Using the above measuring instrument and using an aperture of 100 μm as its aperture, the volume and number of toner particles are measured, and the volume distribution and number distribution are calculated. Then, the proportion of 5.04 μm or smaller particles that is determined from number distribution and the proportion of 12.7 μm or larger particles that is determined from weight distribution are found, which are according to the present invention.

As channels, 13 channels are used, which are of 2.00 to less than 2.52 μm, 2.52 to less than 3.17 μm, 3.17 to less than 4.00 μm, 4.00 to less than 5.04 μm, 5.04 to less than 6.35 μm, 6.35 to less than 8.00 μm, 8.00 to less than 10.08 μm, 10.08 to less than 12.70 μm, 12.70 to less than 16.00 μm, 16.00 to less than 20.20 μm, 20.20 to less than 25.40 μm, 25.40 to less than 32.00 μm, and 32.00 to less than 40.30 μm.

The BET specific surface area in the present invention is measured with a degassing unit VACPREP 061 (manufactured by Micromeritics Co.) and a BET measuring instrument GEMINI 2375 (manufactured by Micromeritics Co.). As to the procedure of preparing a sample, first, the weight of an empty sample cell is measured. Thereafter, the sample cell is so filled with a measuring sample as to come between 1 g and 1.01 g. The sample cell filled with the sample is set in the degassing unit to carry out degassing at room temperature for 3 hours. After the degassing is completed, the whole weight of the sample cell is measured. From its difference from the weight of the empty sample, an accurate weight of the sample is calculated. The procedure of measuring the BET specific surface area is described. First, empty sample cells are set at a balance port and an analysis port of the BET measuring instrument. Next, a Dewar vessel holding liquid nitrogen therein is set at a stated position, and saturated vapor pressure (PO) is measured according to a PO measurement command. After the PO measurement is completed, the sample cell prepared is set at the analysis port. After the sample weight and the PO are inputted, the measurement is started according to the PO measurement command. Then, the BET specific surface area is automatically calculated.

The circularity of each toner in the present invention and its frequency distribution are used as a simple method for expressing the shape of toner quantitatively. In the present invention, they are measured with a flow type particle image analyzer FPIA-1000 Model (manufactured by Toa Iyou Denshi K.K.), and the circularity is calculated according to the following expression.

$$\text{Circularity} = \frac{\text{Circumferential length of a circle with the same area as particle projected area}}{\text{Circumferential length of particle projected image}}$$

Here, the "particle projected area" is meant to be the area of a binary-coded toner particle image, and the "circumferential length of particle projected image" is defined to be the length of a contour line formed by connecting edge points of the toner particle image.

The circularity referred to in the present invention is an index showing the degree of surface unevenness of toner particles. It is indicated as 1.000 when the toner particles are perfectly spherical. The more complicate the surface shape is, the smaller the value of circularity is.

In the present invention, average circularity C which means an average value of circularity frequency distribution and circularity standard deviation SDc are calculated from the following expression where the circularity at a partition point i of particle size distribution (a central value) is represented by ci, and the frequency by $f_{ci}$.

$$\text{Average circularity } C = \sum_{i=1}^{m} (ci \times f_{ci}) \Big/ \sum_{i=1}^{m} (f_{ci})$$

$$\text{Circularity standard deviation } SDc = \left\{ \sum_{i=1}^{m} (C - ci)^2 \Big/ \sum_{i=1}^{m-1} (f_{ci}) \right\}^{1/2}$$

As a specific measuring method, 10 ml of ion-exchanged water from which impurity solid matter and the like have been removed is made ready for use in a container, and as a dispersant a surface-active agent, preferably an alkylbenzene sulfonate, is added thereto. Thereafter, 0.02 g of a measuring sample is further added thereto, followed by uniform dispersion. As a means for the dispersion, an ultrasonic dispersion machine UH-50 (manufactured by SMT Co.) to which a 5 mm diameter titanium alloy tip is attached as a vibrator is used, and dispersion treatment is carried out for 5 minutes to prepare a dispersion for measurement. Here, the dispersion is appropriately cooled so that its temperature does not exceed 40° C.

The shape of toner particles is measured using the above flow type particle image analyzer. Concentration of the dispersion is again so adjusted that the toner particles are in a concentration of from 3,000 to 10,000 particles/μl at the time of measurement, and 1,000 or more toner particles are measured. After measurement, the data obtained are used to determine the average circularity and circularity standard deviation of the toner particles.

As methods for producing the toners used in the present invention, available are a method disclosed in Japanese Patent Publication No. S36-10231, and Japanese Patent Applications Laid-Open No. S59-53856 and No. S59-61842, in which toner is directly produced by suspension polymerization; and a production method in which toner particles are produced by emulsion polymerization as typified by soap-free polymerization, where toner particles are formed by direct polymerization carried out in the presence of a monomer-soluble and water-soluble polymerization initiator. Also available are production methods such as interfacial polymerization like that in the production of microcapsules, in situ polymerization, and coacervation. Further available is an interfacial association method in which at least one kind of fine particles is agglomerated to obtain toner particles, as disclosed in Japanese Patent Applications Laid-open No. S62-106473 and No. S63-186253. Besides, a method is available in which toner particles obtained by pulverization are made spherical by mechanical impact force.

In particular, suspension polymerization is preferred, by which toner particles having small particle diameter and large circularity can be obtained with ease. In the case when the suspension polymerization is used as the method for producing toner particles, the toner particles can be produced directly by a production process as described below.

A monomer composition comprising a polymerizable monomer and added thereto additives such as a colorant, a polymerization initiator and optionally a wax, a polar resin, a charge control agent and a cross-linking agent, which have uniformly been dissolved or dispersed by means of a homogenizer or an ultrasonic dispersion machine, is dispersed in an aqueous medium containing a dispersion stabilizer, by means of a conventional stirrer, or a homomixer, a homogenizer or the like. Granulation is carried out preferably while controlling the stirring speed and time so that droplets of the monomer composition can have the desired toner particle size. After the granulation, stirring may be carried out to such an extent that the state of particles is maintained and the particles can be prevented from settling by the action of the dispersion stabilizer. The polymerization may be carried out at a polymerization temperature set at 40° C. or above, usually from 50 to 90° C. (preferably from 55 to 85° C.). At the latter half of the polymerization, the temperature may be raised, and the pH may also optionally be changed. In the present invention, the aqueous medium may further be removed in part at the latter half of the reaction or after the reaction has been completed, in order to remove unreacted polymerizable monomers, by-products and so forth that may cause an odor when the toner is fixed. After the reaction has been completed, the toner particles formed are washed and collected by filtration, followed by drying.

Materials for such polymerization toners are described below.

As the polymerizable monomer used when the toners used in the present invention are produced by polymerization, usable are vinyl type polymerizable monomers capable of radical polymerization. As the vinyl type polymerizable monomers, monofunctional polymerizable monomers may be used. The monofunctional polymerizable monomers may include styrene; styrene derivatives such as α-methylstyrene, β-methylstyrene, o-methylstyrene, m-methylstyrene, p-methylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene and p-phenylstyrene; acrylate type polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate and 2-benzoyloxy ethyl acrylate; methacrylate type polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate and dibutyl phosphate ethyl methacrylate; methylene aliphatic monocarboxylates; vinyl esters such as vinyl acetate, vinyl propionate, vinyl butyrate, vinyl benzoate and vinyl formate; vinyl ethers such as methyl vinyl ether, ethyl vinyl ether and isobutyl vinyl ether; and vinyl ketones such as methyl vinyl ketone, hexyl vinyl ketone and isopropyl vinyl ketone.

In the present invention, any of the above monofunctional polymerizable monomers may be used alone or in combination of two or more kinds.

As the polymerization initiator used when the above polymerizable monomer is polymerized, an oil-soluble initiator and/or a water-soluble initiator may be used. For example, the oil-soluble initiator may include azo compounds such as 2,2'-azobisisobutyronitrile), 2,2'-azobis-(2,4-dimethylvaleronitrile), 1,1'-azobis-(cyclohexane-1-carbonitrile), and 2,2'-azobis-4-methoxy-2,4-dimethylvaleronitrile; and peroxide type initiators such as acetylcyclohexylsulfonyl peroxide, diisopropylperoxy carbonate, decanonyl peroxide, lauroyl peroxide, stearoyl peroxide, propionyl peroxide, acetyl peroxide, t-butylperoxy-2-ethylhexanoate, benzoyl peroxide, t-butylperoxyisobutyrate, cyclohexanone peroxide, methyl ethyl ketone peroxide, dicumyl peroxide, t-butyl hydroperoxide, di-t-butyl peroxide, and cumene hydroperoxide.

The water-soluble initiator may include ammonium persulfate, potassium persulfate, 2,2'-azobis-(N,N'-dimethyleneisobutyroamidine) hydrochloride, 2,2'-azobis-(2-amidinopropane) hydrochloride, azobis-(isobutylamidine) hydrochloride, 2,2'-azobisisobutyronitrile sodium sulfonate, ferrous sulfate, and hydrogen peroxide.

In order to control the degree of polymerization of the polymerizable monomer, a chain transfer agent, a polymerization inhibitor or the like may further be added.

As a dispersion stabilizer, it may include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, alumina and hydroxylapatite. Water may preferably be used as a dispersion medium usually in amount of from 300 to 3,000 parts by weight based on 100 parts by weight of the monomer composition.

As organic compounds, usable are, e.g., polyvinyl alcohol, gelatin, methyl cellulose, methyl hydroxypropyl cellulose, ethyl cellulose, carboxymethyl cellulose sodium salt, and starch. Any of these dispersion stabilizers may preferably be used in an amount of from 0.2 to 20 parts by weight based on 100 parts by weight of the polymerizable monomer.

Besides, as dispersion stabilizers preferably used, they include slightly water-soluble metal salts of sulfuric acid, carbonic acid, phosphoric acid, pyrophosphoric acid or polyphosphoric acid. These may preferably be prepared by the reaction of an acid alkali metal salt with a halogenated metal salt under high-speed stirring in a dispersion medium.

In order to finely dispersing the dispersion stabilizer, a surface-active agent may be used in an amount of from 0.001 to 0.1 part by weight based on 100 parts by weight of the polymerizable monomer. Specifically, commercially available nonionic, anionic and cationic surface active agents may be employed. For example, preferably usable are sodium dodecylsulfate, sodium tetradecylsulfate, sodium pentadecylsulfate, sodium octylsulfate, sodium oleate, sodium laurate, potassium stearate and calcium oleate.

Where the polar resin is used in the present invention, it may include, e.g., polyester, polycarbonate, phenolic resins, epoxy resins, polyamides and celluloses. More preferably, polyester is desirable in view of a diversity of materials.

As methods for producing the polyester, it may be produced by, e.g., synthesis by oxidation reaction, synthesis from a carboxylic acid and a derivative thereof, ester group introduction as typified by Michael addition reaction, a process utilizing dehydration condensation reaction from a carboxylic acid compound and an alcohol compound, reaction from an acid halide and an alcohol compound, or ester exchange reaction. As a catalyst, any of commonly available acid or alkali catalysts used in esterification reaction may be used, as exemplified by zinc acetate, titanium compounds and so forth. Thereafter, the reaction product may highly be purified by recrystallization, distillation or the like.

A particularly preferred process for producing the polyester is the dehydration condensation reaction from a carboxylic acid compound and an alcohol compound, in view of a diversity of materials and readiness of reaction. In this case, it is preferable that from 45 to 55 mol % in the all components is held by an alcohol component, and from 55 to 45 mol % by an acid component.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the following Formula (I):

(I)

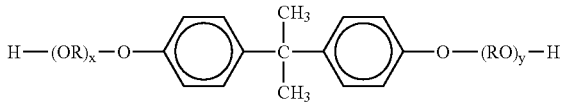

wherein R represents an ethylene group or a propylene group, x and y are each an integer of 1 or more, and an average value of x+y is 2 to 10;

and a diol represented by the following Formula (II):

(II)

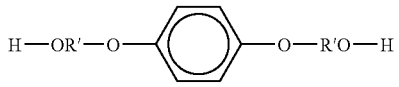

wherein R' represents

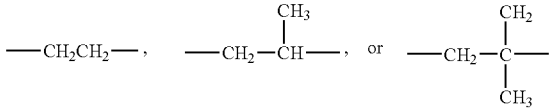

As a dibasic carboxylic acid, it may include benzene dicarboxylic acids and anhydrides thereof, such as phthalic acid, terephthalic acid, isophthalic acid, phthalic anhydride, diphenyl-P.P'-dicarboxylic acid, naphthalene-2,7-dicarboxylic acid, naphthalene-2,6-dicarboxylic acid, diphenylmethane-P.P'-dicarboxylic acid, dibenzophenone-4-4'-dicarboxylic acid, and 1,2-diphenoxyethane-P.P'-dicarboxylic acid; alkyldicarboxylic acids such as succinic acid, adipic acid, sebacic acid and azelaic acid, glutaric acid, cyclohexanedicarboxylic acid, triethylenedicarboxylic acid and malonic acid, and anhydrides thereof, as well as succinic acid further substituted with an alkyl group or alkenyl group having 6 to 18 carbon atoms, or anhydrides thereof; unsaturated dicarboxylic acids such as fumaric acid, maleic acid, citraconic acid and itaconic acid, and anhydrides thereof.

As a particularly preferred alcohol component, it is the bisphenol derivative represented by Formula (I). As a particularly preferred acid component, it may include phthalic acid, terephthalic acid and isophthalic acid, and anhydrides thereof; succinic acid and n-dodecenyl succinic acid, and anhydrides thereof; and dicarboxylic acids such as fumaric acid, maleic acid and maleic anhydride.

A trihydric or higher polycarboxylic acid or polyol may also be used in a small amount as long as it does not affect the present invention adversely.

The tribasic or higher polycarboxylic acid may include trimellitic acid, pyromellitic acid, cyclohexanetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,3-dicarboxyl-2-methylmethylenecarboxypropane, tetra(methylenecarboxyl) methane and 1,2,7,8-octanetetracarboxylic acid, and anhydrides of these.

The trihydric or higher polyol may include sorbitol, 1,2,3,6-hexanetetraol, 1,4-sorbitan, pentaerythritol, dipentaerythritol, tripentaerythritol, sucrose, 1,2,4-methanetriol, glycerol, 2-methylpropanetriol, 2-methyl-1,2,4-butanetriol, trimethylolethane, trimethylolpropane and 1,3,5-trihydroxymethylbenzene.

The wax used in the present invention may include polymethylene waxes such as paraffin wax, polyolefin wax, microcrystalline wax and Fischer-Tropsch wax, amide waxes, ketone waxes, higher fatty acids, long-chain alcohols, ester waxes, and derivatives of these such as graft compounds and block compounds. These may preferably be those from which low-molecular-weight components have been removed and having a sharp maximum endothermic peak in the DSC endothermic curve. A blend of two or more of any of these may also be used.

Waxes preferably usable are straight-chain alkyl alcohols having 15 to 100 carbon atoms, straight-chain fatty acids, straight-chain acid amides, straight-chain esters or montan type derivatives. Any of these waxes from which impurities such as liquid fatty acids have been removed are also preferred.

Waxes more preferably usable may include low-molecular-weight alkylene polymers obtained by radical polymerization of alkylenes under a high pressure or polymerization thereof in the presence of a Ziegler catalyst or any other catalyst under a low pressure; alkylene polymers obtained by thermal decomposition of high-molecular-weight alkylene polymers; those obtained by separation and purification of low-molecular-weight alkylene polymers formed as by-products when alkylenes are polymerized; and polymethylene waxes obtained by extraction fractionation of specific components from distillation residues of hydrocarbon polymers obtained by the Arge process from a synthetic gas comprised of carbon monoxide and hydrogen, or from synthetic hydrocarbons obtained by hydrogenation of distillation residues. Antioxidants may be added to these waxes. In order to improve light transmission properties of fixed images, solid ester waxes are preferred. In the case when toner particles are directly formed in an aqueous medium, any of these waxes may be mixed in an amount of from 1 to 40 parts by weight, and preferably from 3 to 30 parts by weight, based on 100 parts by weight of the polymerizable monomer, and be incorporated into toner particles.

As the colorant used in the present invention, carbon black, and yellow, magenta and cyan colorants shown below are used.

As the yellow colorant, compounds typified by condensation azo compounds, isoindolinone compounds, anthraquinone compounds, azo metal complexes, methine compounds and acylamide compounds are used. Stated specifically, C.I. Pigment Yellow 12, 13, 14, 15, 17, 62, 74, 83, 93, 94, 95, 109, 110, 111, 128, 129, 147, 168 and 180 are preferably used.

As the magenta colorant, condensation azo compounds, diketopyrroropyrole compounds, anthraquinone compounds, quinacridone compounds, basic dye lake compounds, naphthol compounds, benzimidazolone compounds, thioindigo compounds and perylene compounds are used. Stated specifically, C.I. Pigment Red 2, 3, 5, 6, 7, 23, 48:2, 48:3, 48:4, 57:1, 81:1, 122, 146, 150, 166, 169, 177, 184, 185, 202, 206, 220, 221 and 254 are particularly preferable.

As the cyan colorant, copper phthalocyanine compounds and derivatives thereof, anthraquinone compounds and basic dye lake compounds may be used. Stated specifically, C.I. Pigment Blue 1, 7, 15, 15:1, 15:2, 15:3, 15:4, 60, 62 and 66 may particularly preferably be used.

Any of these colorants may be used alone, in the form of a mixture, or in the state of a solid solution. The colorants used in the present invention are selected taking account of hue angle, chroma, brightness, weatherability, transparency on OHP films and dispersibility in toner particles. The colorant may preferably be used in an amount of from 1 to 20 parts by weight based on 100 parts by weight of the resin.

The toners according to the present invention may each contain a charge control agent.

As charge control agents capable of controlling the toners to be negatively chargeable, for example, organic metal complexes or chelate compounds are effective, which may include monoazo metal compounds, acetylacetone metal compounds, and metal compounds of aromatic hydroxycarboxylic acids and aromatic dicarboxylic acids. Besides, they may include aromatic hydroxycarboxylic acids, aromatic mono- and polycarboxylic acids, and metal salts, anhydrides or esters thereof, as well as phenolic derivatives such as bisphenol. They may further include urea derivatives, metal-containing salicylic acid compounds, metal-containing naphthoic acid compounds, boron compounds, and carixarene.

Alternatively, as charge control agents capable of controlling the toners to be positively chargeable, they may include Nigrosine and Nigrosine-modified products, modified with a fatty acid metal salt or the like; guanidine compounds; imidazole compounds; quaternary ammonium salts such as tributylbenzylammonium 1-hydroxy-4-naphthosulfonate and tetrabutylammonium teterafluoroborate, and analogues of these, including onium salts such as phosphonium salts, and lake pigments of these; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more kinds.

As an external additive to toners which is usable in the present invention, inorganic fine particles such as silica or titanium oxide may preferably be used. Besides, an oxide such as zirconium oxide or magnesium oxide may be used, and besides silicon carbide, silicon nitride, boron nitride, aluminum nitride, magnesium carbonate, an organosilicon compound or the like may also be used in combination.

The silica is preferred because the coalescence of primary particles can be controlled arbitrarily to a certain extent, by selecting starting materials or oxidation conditions such as temperature. For example, such silica includes what is called dry-process silica or fumed silica produced by vapor phase oxidation of silicon halides or alkoxides and what is called wet-process silica produced from alkoxides or water glass, either of which may be used. The dry-process silica is preferred, as having less silanol groups on the surface and inside and leaving less production residues such as $Na_2O$ and $SO_3^{2-}$. In the dry-process silica, it is also possible to use, in its production step, other metal halide such as aluminum chloride or titanium chloride together with the silicon halide to obtain a composite fine powder of silica with other metal oxide. The silica includes these as well.

It is preferable for the silica to have been further subjected to hydrophobic treatment, in order to make the toners' charge quantity less dependent on environment such as temperature and humidity and to prevent the silica from becoming liberated in excess from toner particle surfaces. Agents for such hydrophobic treatment may include, e.g., coupling agents such as a silane coupling agent, a titanium coupling agent and an aluminum coupling agent. In particular, the silane coupling agent is preferred in view of the feature that it reacts with residual groups or adsorbed water on inorganic fine oxide particles to achieve uniform treatment to make the charging of toners stable and impart fluidity to the toners.

The silane coupling agent may preferably be one represented by the following general formula:

$$R_mSiY_n$$

R: an alkoxyl group;

m: an integer of 1 to 3;

Y: a hydrocarbon group such as an alkyl group, a vinyl group, a glycidoxyl group or a methacrylic group; and n: an integer of 1 to 3;

and may include, e.g., vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

It may more preferably be one represented by $C_aH_{2a+1}$—$Si(OC_bH_{2b+1})_3$, wherein a is 4 to 12 and b is 1 to 3.

Here, if a in the general formula is smaller than 4, the treatment can be easier but no satisfactory hydrophobicity can be achieved. If a is larger than 12, a satisfactory hydrophobicity can be achieved but the coalescence of particles may more occur, resulting in a lowering of fluidity-providing performance. If b is larger than 3, the reactivity may lower to make the particles insufficiently hydrophobic. The a in the above formula may preferably be 4 to 12, and more preferably 4 to 8, and also the b may preferably be 1 to 3, and more preferably 1 or 2.

As a silane coupling agent containing nitrogen element, hexamethyldisilazane is preferred from the standpoint of readiness for reaction control and also from the viewpoint of charging stability.

The treatment may be carried out using the silane coupling agent in an amount of from 1 to 50 parts by weight based on 100 parts by weight of the silica fine particles, and preferably from 3 to 40 parts by weight in order to make uniform treatment without causing any coalescence.

Especially in the present invention, it is particularly preferable to use silica having been treated with an oil. There is no problem if untreated silica is directly treated with an oil. Preferably, it is desirable that the silica having been subjected to hydrophobic treatment is further treated with an oil. As the oil, usable are dimethylpolysiloxane, methylhydrogenpolysiloxane, paraffin, mineral oil and the like. In particular, dimethylpolysiloxane is preferred, as having superior environmental stability. The treatment may be carried out using the oil in an amount, as suitable amount, of from 2 to 40 parts by weight based on 100 parts by weight of the silica fine particles as a base.

In the present invention, a titanium oxide may also be used. There are no particular limitations on its production process. A process may be used in which a titanium halide or alkoxide is oxidized in a gaseous phase, or a process in which the titanium oxide is formed carrying out hydrolysis in the presence of water. For example, usable are amorphous titanium oxide, anatase type titanium oxide and rutile type titanium oxide. Such fine titania particles may also be subjected to, like silica, hydrophobic treatment or oil treatment.

In the toners used in the present invention, other additives may be used in small quantities as long as they do not substantially have any ill effects. Such additives may include, e.g., lubricants such as polyethylene fluoride powder, zinc stearate powder and polyvinylidene fluoride powder; abrasives such as cerium oxide powder, silicon carbide powder and strontium titanate powder; anti-caking agents such as aluminum oxide; and conductivity-providing agents such as carbon black powder, zinc oxide powder and tin oxide powder. Reverse-polarity organic fine particles and inorganic fine particles may also be used in a small amount as a developing performance improver.

In the case when the toners in the present invention are used as two-component developers, a magnetic carrier is used together with the toners in the present invention to make up the two-component developers. As the magnetic carrier, it is constituted of an iron or like element alone or in the state of a composite ferrite. As the particle shape of the magnetic carrier, it may be spherical, flat or amorphous. Further, it is preferable to control surface microstructure (e.g., surface unevenness) of magnetic carrier particles. A method is commonly used in which an inorganic oxide is fired and granulated to form magnetic carrier core particles previously, and thereafter the core particles are coated with a resin. From the import to lessen a load of magnetic carrier-on toner, also usable are a method in which the inorganic oxide and the resin are kneaded, followed by pulverization and classification to obtain a low-density disperse carrier and also a method in which a mixture of the inorganic oxide and a monomer is directly subjected to suspension polymerization in an aqueous medium to obtain a true-spherical magnetic carrier.

Image-forming methods to which the present invention is applicable are described below with reference to the accompanying drawings.

In FIG. 1, a developing assembly 4 is a two-component contact developing assembly (two-component magnetic-brush developing assembly), and holds a developer consisting of a carrier and a toner, on a developing sleeve 41 provided internally with a magnet roller. The developing sleeve 41 is provided with a developer control blade 42, leaving a stated gap. The developer control blade 42 forms a developer thin layer on the developing sleeve 41 as the developing sleeve 41 is rotated.

The developing sleeve 41 is so disposed as to have a stated gap between it and a photosensitive drum 1, and is so set that the developer thin layer formed on the developing sleeve 41 can perform development in the state it is in contact with the photosensitive drum 1. Inside the developing assembly 4, agitation screws 43 and 44 for agitating the developer are provided, which have the function to rotate in synchronization with the rotation of the developing sleeve 41 and agitate the toner and carrier supplied, to provide the toner with a stated triboelectricity. Incidentally, in FIG. 1, reference numeral 2 denotes a charging roller which is a charging means; 3, exposure light; and 6, a cleaning means.

Figure 2:
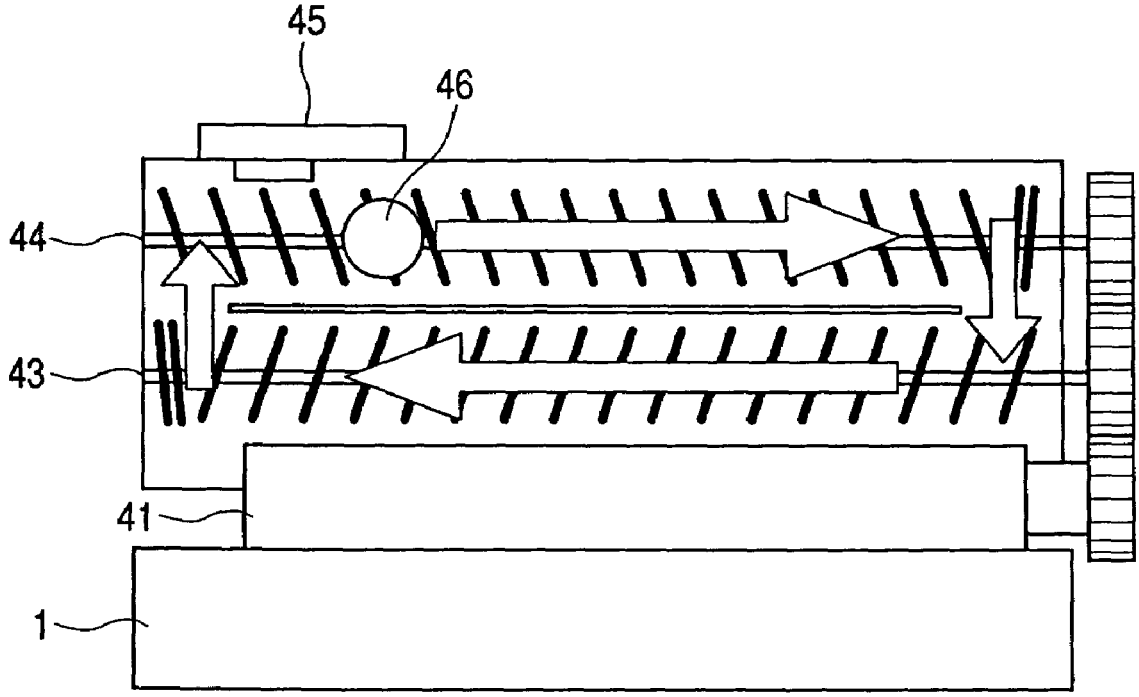
FIG. 2 is a view of a developing assembly shown in FIG. 1, as viewed from above it.

FIG. 2 is a view of the developing assembly 4 as viewed from above it, and shows the state of circulation of the developer and the lengthwise disposition of the assembly. As the screws 43 and 44 are rotated, the developer circulates in the directions shown by arrows. On the wall surface of the developing assembly 4 on its upstream side of the screw 44, a sensor 45 is provided which detects changes in permeability of the developer to detect toner concentration in the developer. A toner replenishment opening 46 is provided on the somewhat downstream side of this sensor 45. After the development has been performed, the developer is carried to the part of the sensor 45, where the toner concentration is detected. In order to maintain the toner concentration in the developer to a constant level in accordance with the results of the detection, the toner is appropriately replenished from a developer feed unit (hereinafter "T-CRG") 5 through the opening 46 of the developing assembly 4. The toner thus replenished is transported by the screw 44 to become blended with the carrier each other and provided with appropriate triboelectricity, and thereafter it is carried to the vicinity of the developing sleeve 41, where its thin layer is formed on the developing sleeve 41 and used for the development.

Inside the T-CRG 5, a toner-replenishing roller 51 is provided, which controls toner replenishment quantity by the number of rotation (rotation time).

Figure 3:
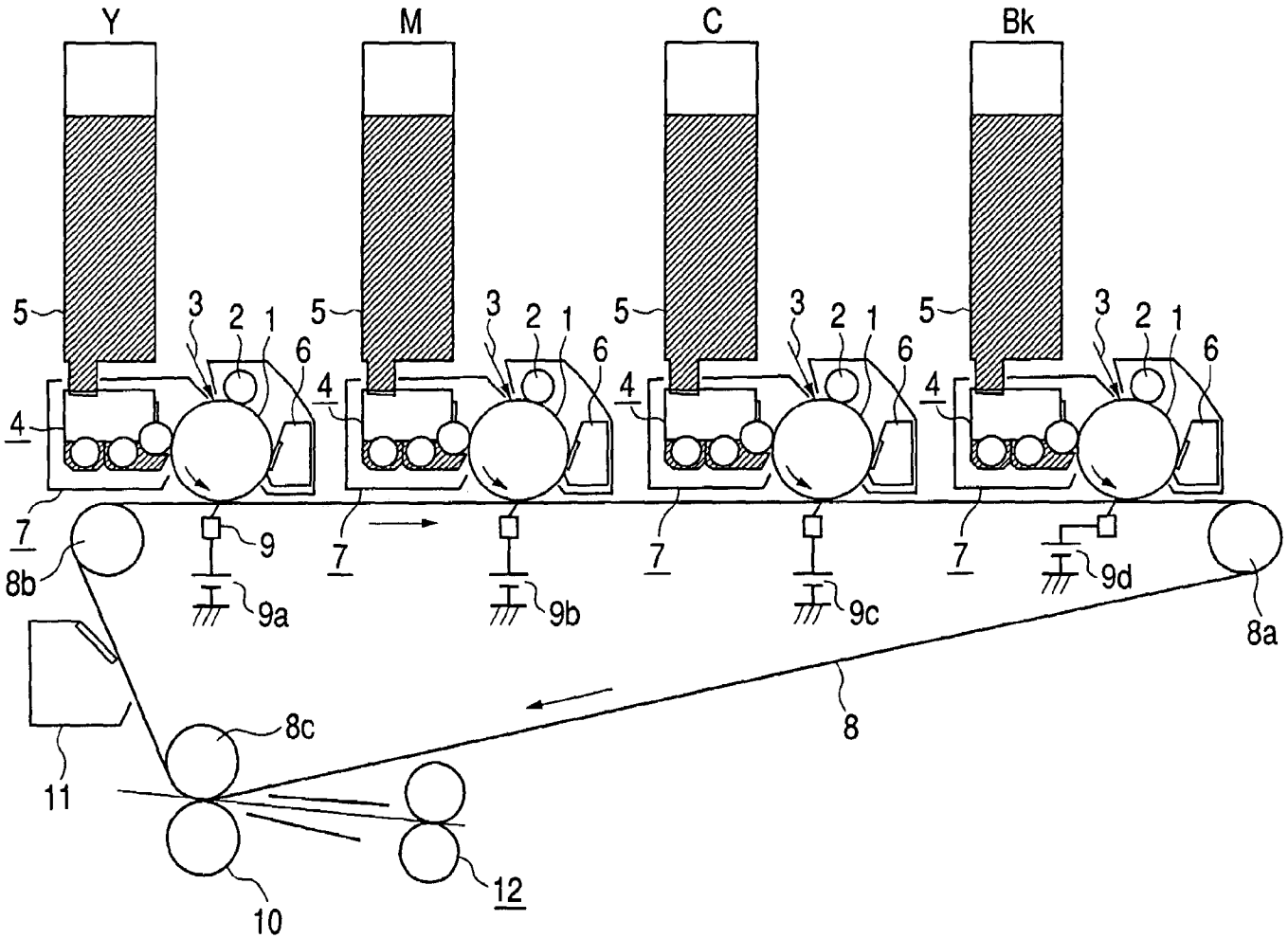
FIG. 3 illustrates a color laser printer.

FIG. 3 is a schematic view of a four-tandem drum type (in-line) printer for obtaining full-color printed images, which has a plurality of process cartridges 7 and in which the toner images are first continuously superimposingly multiple-transferred to a second image-bearing member, intermediate transfer belt 8. In FIG. 3, an endless intermediate transfer belt 8 is stretched over a drive roller 8*a*, a tension roller 8*b* and a secondary transfer opposing roller 8*c*, and is rotated in the direction of an arrow shown in the drawing.

Four process cartridges (hereinafter "P-CRG"s) 7 are arranged in series along the intermediate transfer belt 8 and correspondingly to the respective colors.

This P-CRG is described below.

A photosensitive drum 1 disposed in a P-CRG which performs development with a yellow toner is, in the course of its rotation, uniformly electrostatically charged to stated polarity and potential by means of a primary charging roller 2 and then subjected to imagewise exposure 3 by an imagewise exposure means (not shown) (e.g., an optical exposure system for color separation and image formation of color original images, or a scanning exposure system by laser scanning that outputs laser beams modulated in accordance with time-sequential electrical digital pixel signals of image information), so that an electrostatic latent image is formed which corresponds to a first color component image (e.g., a yellow color component image) of an intended full-color image.

Next, the electrostatic latent image thus formed is developed with a first-color yellow toner by means of a first developing assembly (yellow developing assembly) 4. The yellow toner image formed on the photosensitive drum 1 enters a primary transfer nip between the photosensitive drum 1 and the intermediate transfer belt 8. At this transfer nip, a flexible electrode 9 is kept in contact with the back of the intermediate transfer belt 8. The flexible electrode 9 is provided in each port, and has a primary transfer bias source 9*a*, 9*b*, 9*c* or 9*d* so that bias can independently be applied for each port. The yellow toner image is first transferred to the intermediate transfer belt 8 at the first-color port. Subsequently, a magenta toner image, a cyan toner image and a black toner image which have been formed through the same steps as those described above are superimposingly multiple-transferred in sequence at the respective ports from photosensitive drums 1 corresponding to the respective colors. Incidentally, reference numeral 10 denotes a transfer roller; 11, an intermediate-transfer-belt cleaner; and 12, a fixing assembly.

Figure 4:
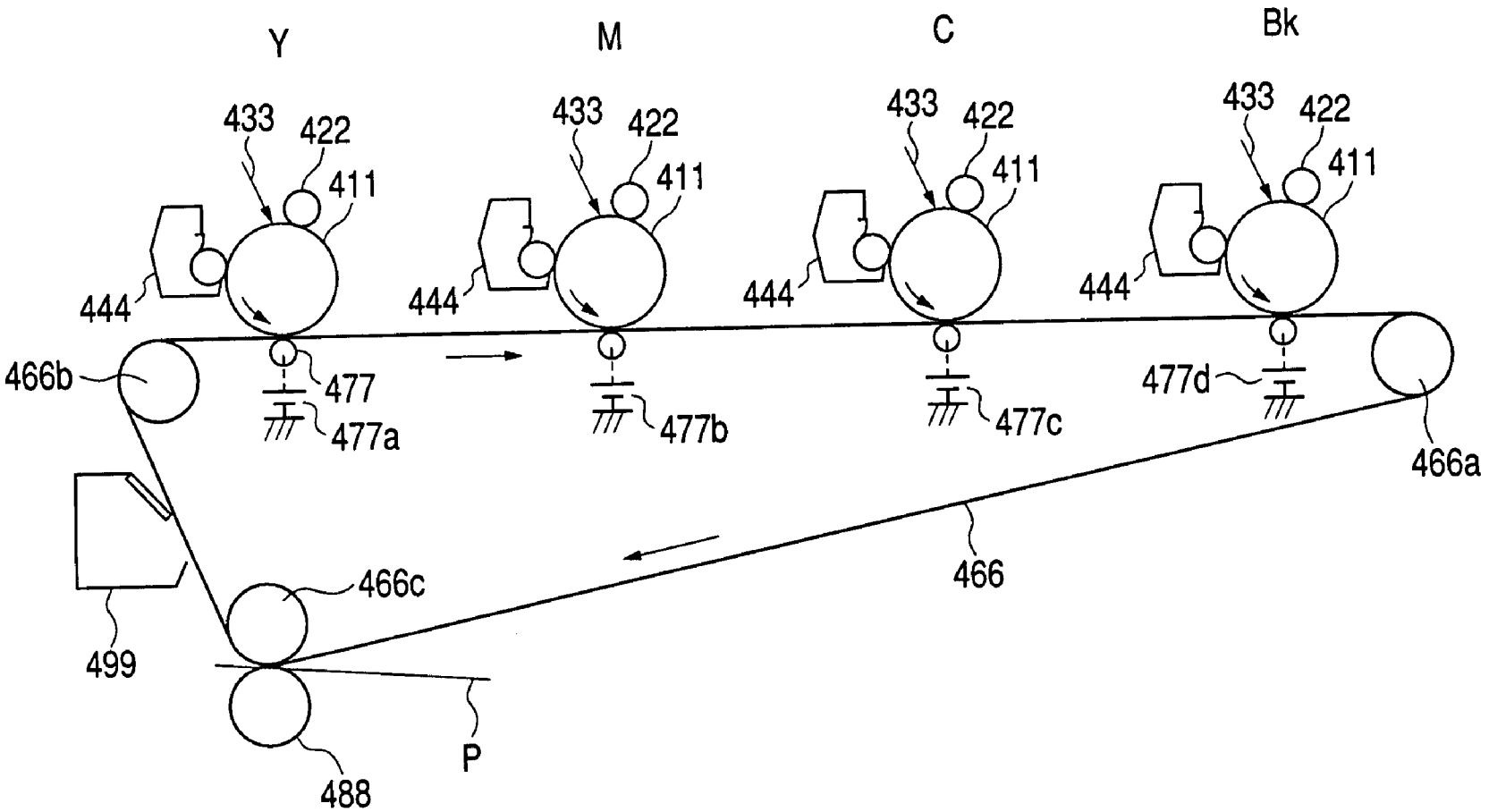
FIG. 4 illustrates another embodiment of the color laser printer.

FIG. 4 shows an example of a color laser printer making use of a developing means serving also as a means for collecting transfer residual toners. The color laser printer shown in FIG. 4 is a four-tandem drum type (tandem type) printer for obtaining full-color printed images, which has a plurality of photosensitive drums 411 which are electrostatic-latent-image-bearing members as first image-bearing members and in which toner images are continuously superimposingly multiple-transferred in sequence to a second image-bearing member intermediate transfer belt 466, to obtain a full-color printed image.

In FIG. 4, an endless intermediate transfer belt 466 is stretched over a drive roller 466*a*, a tension roller 466*b* and a secondary transfer opposing roller 466*c*, and is rotated in the direction of an arrow shown in the drawing.

Four photosensitive drums 411 are arranged in series in the movement direction of the intermediate transfer belt 466 and correspondingly to the respective colors.

A photosensitive drum 411 accompanied by a yellow developing assembly is, in the course of its rotation, uniformly electrostatically charged to stated polarity and potential by means of a primary charging roller 422 and then subjected to imagewise exposure 433 by an imagewise exposure means (not shown) (e.g., an optical exposure system for color separation and image formation of color original images, or a scanning exposure system by laser scanning that outputs laser beams modulated in accordance with time-sequential electrical digital pixel signals of image information), so that an electrostatic latent image is formed which corresponds to a first color component image (e.g., a yellow color component image) of an intended full-color image. Next, the electrostatic latent image thus formed is developed with a first-color yellow toner by means of a first developing assembly 444 (yellow developing assembly).

The yellow toner image formed on the photosensitive drum 411 enters a primary transfer nip between the photosensitive drum 411 and the intermediate transfer belt 466. At this transfer nip, a voltage application means 477 is kept in contact with the back of the intermediate transfer belt 466. The voltage application means 477 is provided in each port, and has a primary transfer bias source 477*a*, 477*b*, 477*c* or 477*d* so that bias can independently be applied for each port. The yellow toner image is first transferred to the intermediate transfer belt 466 at the first-color port. Subsequently, a magenta toner image, a cyan toner image and a black toner image which have been formed through the same steps as those described above are superimposingly multiple-transferred in sequence at the respective ports from photosensitive drums 411 corresponding to the respective colors.

Toners left on the photosensitive drums 411 are again charged by primary charging rollers 422, and collected at development zones. Alternatively, the transfer residual toners are allowed to pass the development zones, then sent to non-image areas of the intermediate transfer belt 466, and collected in a cleaning assembly 499 provided on the periphery of the intermediate transfer belt 466.

Four full-color toner images having superimposingly been formed on the intermediate transfer belt 466 are then transferred to a transfer material P at one time by means of a secondary transfer roller 488, followed by fixing by fusion by means of a fixing assembly (not shown) to form a full-color printed image.

Figure 6:
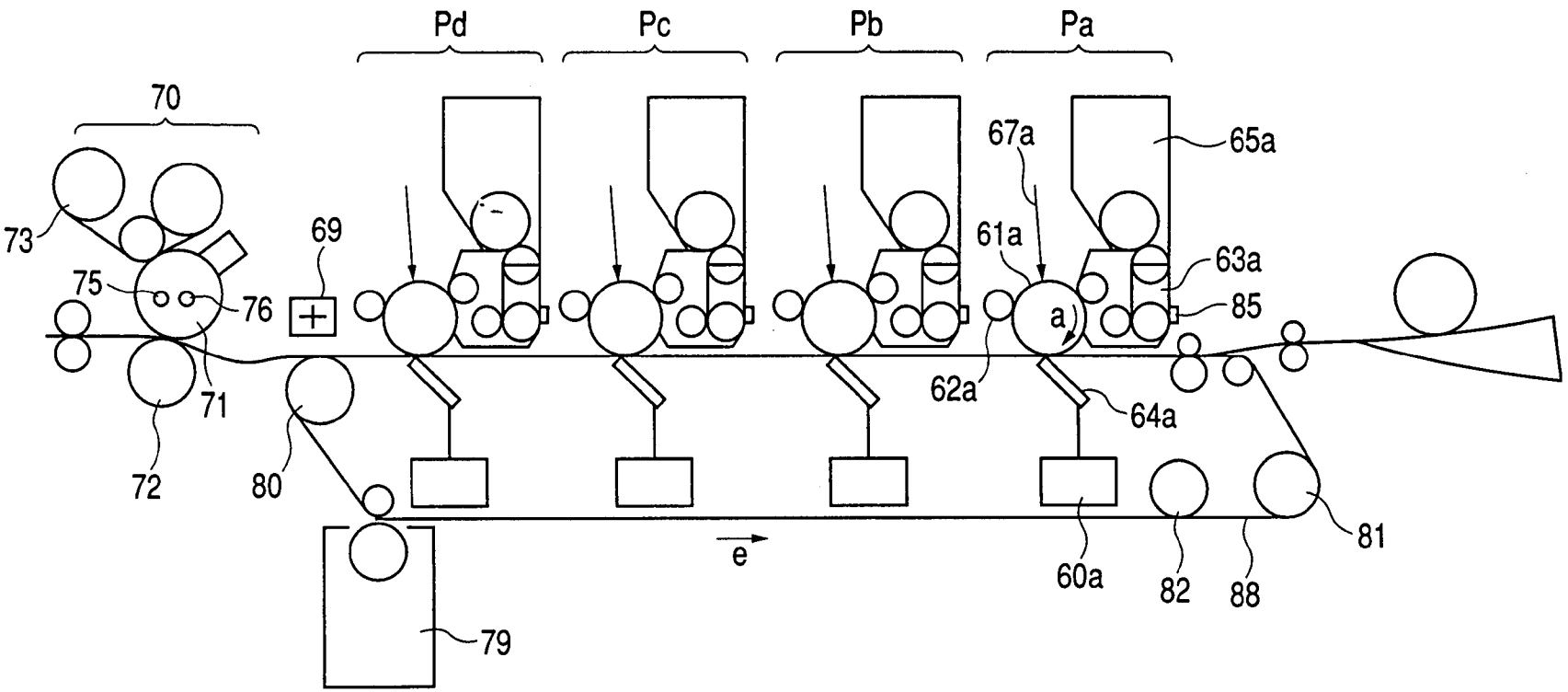
FIG. 6 illustrates another image-forming method to which the present invention is applicable.

FIG. 6 schematically illustrates another full-color image-forming apparatus which can carry out the image forming method of the present invention.

The main body of this image forming apparatus is provided side by side with a first image forming unit Pa, a second image forming unit Pb, a third image forming unit Pc and a fourth image forming unit Pd, and images with respectively different colors are formed on a transfer material through the process of latent image formation, development and transfer. The respective image forming unit provided side by side in the image forming apparatus are each constituted as described below taking the case of the first image forming unit Pa.

The first image forming unit Pa has an electrophotographic photosensitive drum 61*a* of 30 mm diameter as the electrostatic-latent-image-bearing member. This photosensitive drum 61*a* is rotatingly moved in the direction of an arrow a. Reference numeral 62*a* denotes a primary charging assembly as a charging means, and a conductive elastic roller of, e.g., 18 mm in diameter is so provided as to be in contact with the photosensitive drum 61*a*. Reference numeral 67*a* denotes laser light for forming an electrostatic latent image on the photosensitive drum 61*a* whose surface is electrostatically charged by the primary charging assembly 62*a*, and is emitted from an exposure assembly (not shown). Reference numeral 63*a* denotes a developing assembly as a developing means for developing the electrostatic latent image held on the photosensitive drum 61*a*, to form a color toner image, which holds a color toner. Reference numeral 64*a* denotes a transfer blade as a transfer means for transferring the color toner image formed on the surface of the photosensitive. drum 61*a*, to the surface of a transfer material transported by a beltlike transfer material carrying member 88. This transfer blade 64*a* comes into touch with the back of the transfer material carrying member 88 and can apply a transfer bias through a transfer bias means 60*a*.

In this first image forming unit Pa, the photosensitive drum 61*a* is uniformly primarily charged by the primary charging assembly 62*a*, and thereafter the electrostatic latent image is formed on the photosensitive drum 61*a* by the exposure laser light 67*a*. The electrostatic latent image is developed by the developing assembly 63*a* using a color toner. The toner image thus formed by development is transferred to the surface of the transfer material by applying transfer bias from the transfer blade 64*a* coming into touch with the back of the beltlike transfer material carrying member 88 carrying and transporting the transfer material, at a first transfer zone (the position where the photosensitive drum and the transfer material come into contact).

The toner is consumed as a result of the development and T/C ratio (toner/carrier blend ratio) lowers, whereupon this lowering is detected by a toner concentration detecting sensor 85 which measures changes in permeability of the developer by utilizing the inductance of a coil, and a replenishing toner 65*a* is replenished in accordance with the quantity of the toner consumed. Incidentally, the toner concentration detecting sensor 85 has a coil (not shown) on its inside.

In this image forming apparatus, the second image forming unit Pb, third image forming unit Pc and fourth image forming unit Pd, constituted in the same way as the first image forming unit Pa but having different color toners held in the developing assemblies are provided side by side. For example, a yellow toner is used in the first image forming unit Pa, a magenta toner in the second image forming unit Pb, a cyan toner in the third image forming unit Pc and a black toner in the fourth image forming unit Pd, and the respective color toners are sequencially transferred to the transfer material at the transfer zones of the respective image forming units. In this course, the respective color toners are superimposed while making registration, on the same transfer material during one-time movement of the transfer material. After the transfer is completed, the transfer material is separated from the surface of the transfer material carrying member 88 by a separation charging assembly 69, and then sent to a fixing assembly 70 by a transport means such as a transport belt, where a final full-color image is formed by only-one-time fixing.

The fixing assembly 70 has a 40 mm diameter fixing roller 71 and a 30 mm diameter pressure roller 72 in pair. The fixing roller 71 has heating means 75 and 76 on its inside. Reference numeral 73 denotes a web for removing stains present on the fixing roller.

Unfixed color toner images transferred onto the transfer material are passed through a pressure contact zone between the fixing roller 71 and the pressure roller 72 of this fixing assembly 70, whereupon they are fixed onto the transfer material by the action of heat and pressure.

Incidentally, in the apparatus shown in FIG. 6, the transfer material carrying member 88 is an endless beltlike member. This beltlike member is moved in the direction of an arrow e by a drive roller 80. Reference numeral 79 denotes a transfer belt cleaning device; 81, a belt follower roller; and 82, a belt charge eliminator. Reference numeral 83 denotes a pair of registration rollers for transporting to the transfer material carrying member 88 the transfer materials kept in a transfer material holder.

As the transfer means, the transfer blade coming into touch with the back of the transfer material carrying member may be changed for a contact transfer means that comes into contact with the back of the transfer material carrying member and can directly apply a transfer bias, as exemplified by a roller type transfer roller.

The toner kit of the present invention has the black toner and the color toners in the state they stand separate from one another. The toner kit of the present invention may be used by setting it in a developing unit, image-forming apparatus or process cartridge (P-CRG) having two or more independent toner containers. It may also have a form of toner cartridges (T-CRGs) in common use, such as P-CRGs or T-CRGs holding toners or developers composed of mixtures of toners and carriers, or cartridges having integral sets of P-CRGs and T-CRGs.

In the present invention, when the charging roller is used, preferable process conditions are as follows: Contact pressure of the charging roller is 5 to 300 N/m; and, when a voltage formed by superimposing an AC voltage on a DC voltage is used, AC voltage is 0.5 to 5 kVpp, AC frequency is 50 Hz to 5 kHz and DC voltage is ±0.2 to ±1.5 kV, and when a DC voltage is used, the DC voltage is ±0.2 to ±5 kV.

The charging roller or charging blade serving as the contact charging means may preferably be made of conductive rubber, and a release coating may be provided on its surface. To form the release coating, it is possible to use nylon resins, PVDF (polyvinylidene fluoride) and PVDC (polyvinylidene chloride).

In selecting materials for the transfer belt, the registration at each port must be made well, and hence materials which may undergo contraction and expansion are undesirable. It is desirable to use a resin type belt, a rubber belt with a metal core sheet, or a resin-plus-rubber belt.

EXAMPLES

The present invention is described below in greater detail by giving Examples. These by no means limit the present invention. In the following formulation, "part(s)" refers to part(s) by weight unless particularly noted.

Toner Production Example 1

An aqueous dispersion medium and a polymerizable-monomer composition were each prepared in the following way.

Preparation of Aqueous Dispersion Medium:

In a vessel having an internal volume of 200 liters, the following components were mixed. The mixture obtained was heated to 60° C. and thereafter stirred at a number of revolutions of 55 $s^{-1}$ (number of revolutions per second, r.p.s.) by means of a high-speed rotary-shearing stirrer.

| | (by weight) |
|---|---|
| Water | 950 parts |
| Aqueous 0.1 mol/liter $Na_3PO_4$ solution | 450 parts |

Next, the inside of the vessel was displaced with nitrogen and at the same time 68 parts by weight of an aqueous 1.0 mol/liter $CaCl_2$ solution was added therein to carry out reaction to obtain an aqueous dispersion medium containing fine particles of calcium phosphate.

Preparation of Polymerizable-Monomer Composition:

| | (by weight) |
|---|---|
| Styrene | 150 parts |
| n-Butyl acrylate | 20 parts |
| Colorant (C.I. Pigment Yellow 180) | 6 parts |
| Di-t-butylsalicylic acid aluminum compound | 2 parts |
| Polyester resin | 15 parts |
| Ester wax (behenyl behenate; melting point: 65° C.) | 30 parts |

Among the above components, the components other than the polyester resin and ester wax were mixed, and the mixture obtained was subjected to dispersion for 3 hours by means of an attritor (manufactured by Mitsui Miike Engineering Corporation), and thereafter the polyester resin and ester wax were added, which were then heated to 60° C. and mixed for 1 hour to obtain a polymerizable-monomer composition. The polyester resin used is a polycondensation product of bisphenol A propylene oxide, terephthalic acid and trimellitic acid in a mole ratio of 17:82:1 and has physical properties: number-average molecular weight (Mn) of 4,000, weight-average molecular weight (Mw) of 11,000, peak molecular weight of 7,000, Tg of 70° C., and acid value of 5 mg·KOH/g.

The number of revolutions of the high-speed rotary-shearing stirrer holding therein the aqueous dispersion medium prepared as described above was set at 55 $s^{-1}$, and the polymerizable-monomer composition prepared as described above was introduced into the stirrer to start granulation. On lapse of 3 minutes after the start of granulation, a solution prepared by dissolving 7 parts by weight of a polymerization initiator 2,2'-azobis(2,4-dimethylvaleronitrile) in 30 parts by weight of styrene was added to continue the granulation for further 12 minutes. After the granulation was carried out for 15 minutes in total, the reaction mixture was moved into a vessel of a stirrer having a propeller stirring blade and, setting its number of revolutions at 0.83 $s^{-1}$, the reaction was continued at an internal temperature of 62° C. After 6 hours, the reaction temperature was raised to 80° C., and the heating and stirring were continued for 5 hours to complete polymerization. After the polymerization reaction was completed, residual monomers were evaporated off under reduced pressure, and the resultant mixture was cooled. Thereafter, dilute hydrochloric acid was added thereto to dissolve the dispersant, followed by solid-liquid separation, water washing, filtration and drying to obtain yellow toner particles.

Toner Production Example 2

Magenta toner particles were produced in the same manner as in Toner Production Example 1 except that the colorant used therein was changed for C.I. Pigment Red 150.

Toner Production Example 3

Cyan toner particles were produced in the same manner as in Toner Production Example 1 except that the colorant used therein was changed for C.I. Pigment Blue 15:3.

Toner Production Example 4

Black toner particles were produced in the same manner as in Toner Production Example 1 except that the number of revolutions of the high-speed rotary-shearing stirrer, set therein at the time of the start of granulation was changed to 45 $s^{-1}$ and the colorant used therein was changed for carbon black.

Toner Production Example 5

Yellow toner particles were produced in the same manner as in Toner Production Example 1 except that in place of the aqueous 0.1 mol/liter $Na_3PO_4$ solution used therein an aqueous 0.2 mol/liter $Na_3PO_4$ solution was used and the aqueous 1.0 mol/liter $CaCl_2$ solution was added in an amount changed to 136 parts.

Toner Production Example 6

Magenta toner particles were produced in the same manner as in Toner Production Example 5 except that the colorant used therein was changed for C.I. Pigment Red 150.

Toner Production Example 7

Cyan toner particles were produced in the same manner as in Toner Production Example 5 except that the colorant used therein was changed for C.I. Pigment Blue 15:3.

Toner Production Example 8

Black toner particles were produced in the same manner as in Toner Production Example 5 except that the number of revolutions of the high-speed rotary-shearing stirrer, set therein at the time of the start of granulation was changed to 45 $s^{-1}$ and the colorant used therein was changed for carbon black.

Toner Production Example 9

Yellow toner particles were produced in the same manner as in Toner Production Example 1 except that in place of the aqueous 0.1 mol/liter $Na_3PO_4$ solution used therein an aqueous 0.08 mol/liter $Na_3PO_4$ solution was used and the aqueous 1.0 mol/liter $CaCl_2$ solution was added in an amount changed to 55 parts.

Toner Production Example 10

Magenta toner particles were produced in the same manner as in Toner Production Example 9 except that the colorant used therein was changed for C.I. Pigment Red 150.

Toner Production Example 11

Cyan toner particles were produced in the same manner as in Toner Production Example 9 except that the colorant used therein was changed for C.I. Pigment Blue 15:3.

Toner Production Example 12

Black toner particles were produced in the same manner as in Toner Production Example 9 except that the number of revolutions of the high-speed rotary-shearing stirrer, set therein at the time of the start of granulation was changed to 45 $s^{-1}$ and the colorant used therein was changed for carbon black.

Toner Production Example 13

On the toner produced in Toner Production Example 4, its fine powder was cut off by means of a classifier to obtain black toner particles.

Toner Production Example 14

Black toner particles were produced in the same manner as in Toner Production Example 1 except that the colorant used therein was changed for carbon black.

Toner Production Example 15

Black toner particles were produced in the same manner as in Toner Production Example 1 except that in place of the aqueous 0.1 mol/liter $Na_3PO_4$ solution used therein an aqueous 0.05 mol/liter $Na_3PO_4$ solution was used, the aqueous 1.0 mol/liter $CaCl_2$ solution was added in an amount changed to 34 parts and the colorant used therein was changed for carbon black.

Toner Production Example 16

| | (by weight) |
|---|---|
| Styrene-n-butylacrylate copolymer (Mn: 23,000; Mw: 200,000; styrene/n-butylacrylate: 84/16; Tg: 65.8° C.) | 100 parts |
| Carbon black | 6 parts |
| Di-t-butylsalicylic acid aluminum compound | 4 parts |
| Ester wax (behenyl behenate; melting point: 65° C.) | 2 parts |

The above materials were thoroughly premixed by means of a Henschel mixer, and the mixture obtained was melt-kneaded by means of a twin-screw extruder. The kneaded product obtained was cooled, thereafter crushed in sizes of about 1 mm to about 2 mm using a hammer mill, and then finely pulverized by means of a fine grinding machine of an air jet system. The finely pulverized product was further classified to produce black toner particles.

Example 1

The yellow toner particles obtained in Toner Production Example 1 and the cyan toner particles obtained in Toner Production Example 3 were used after they were put to some particle size adjustment of fine powder or coarse powder by classification, and the magenta particles and black toner particles obtained in Toner Production Examples 2 and 4, respectively, were used as they were. To 100 parts of each of the yellow (Y), magenta (M), cyan (C) and black (B) toner particles, the external additives shown in Table 1 were mixed in the amounts also shown in Table 1, using Henschel Mixer 10B (manufactured by Mitsui Miike Engineering Corporation) and under conditions of a number of revolutions of 3,000 r.p.m. and an agitation time of 4 minutes to obtain toners with negative triboelectric chargeability. Physical properties of the respective toners are shown in Tables 3(A) and 3(B). Methods of measuring triboelectric charge quantity and degree of agglomeration are described later.

The toners thus obtained were each filled into the replenishing toner cartridge shown in FIG. 1, in an amount of 500 g for each color to make up a four-color replenishing toner kit.

Besides, to 7 parts each of these toners, 93 parts of an acrylic-resin-coated ferrite carrier was blended to prepare two-component developers. These two-component developers were each filled into the developer shown in FIG. 1, in an amount of 250 g for each color to make up a four-color process toner kit.

Using the above toner kit, a 50,000-sheet (A4 size) continuous printing test was conducted in a moderate-temperature and moderate-humidity environment of 20° C./55% RH and a high-temperature and high-humidity environment of 30° C./80% RH, using the full-color image-forming apparatus shown in FIG. 3. As a sample image, an image with a print percentage of 4% for each color in respect to the paper area was used. As the result, both at the initial stage and after 50,000-sheet printing, the toners showed good transfer performance. Results of evaluation made on the basis of the following evaluation methods are shown in Table 5.

—Evaluation Methods—

(1) Transfer Performance to Cardboard:

Evaluation was made on the transfer image density unevenness of solid black images that appeared when the transfer current was adjusted to that which showed the best transfer efficiency in respect of whole-solid superimposed images formed using yellow, magenta and cyan three colors on cardboad of 130 g/$m^2$ in basis weight. Evaluation criteria are as follows:

A: Uniform solid black images are printed.

B: Images are perceivable to be slightly coarse and non-uniform solid images when looked holding them to intense light.

C: Images are slightly coarse and non-uniform solid images.

D: Images are coarse and non-uniform solid images.

(2) Difference Between First-Side Printing and Second-Side Printing in Double-Side Printing:

Solid black images were double-side printed in the state that the transfer current was adjusted to that which showed the best transfer efficiency in respect of whole-solid superimposed images formed using yellow, magenta and cyan three colors on plain paper of 75 g/$m^2$ in basis weight. Evaluation criteria are as follows:

A: Uniform solid black images are printed on both sides.

B: Images are slightly non-uniform solid black images in the first-side printing, but uniform in the second-side printing.

C: Images are slightly non-uniform solid images in both the first-side printing and the second-side printing.

D: Non-uniform solid images are perceivable in the first-side printing.

(3) Transfer Current Proper Range Between Color Toners and Black Toner:

The relationship between transfer current and transfer efficiency was examined at intervals of 1 μA in respect of respective yellow, magenta, cyan and black toners, on plain paper of 75 g/m$^2$ in basis weight, and transfer current values were measured at which the transfer efficiency for each color was 85% or more. From the measurements obtained, regions where their transfer current ranges overlap between the color toners and black toner were calculated.

The transfer efficiency in this evaluation is calculated from the proportion of toner laid-on quantity per unit area before and after secondary transfer.

Figure 5:
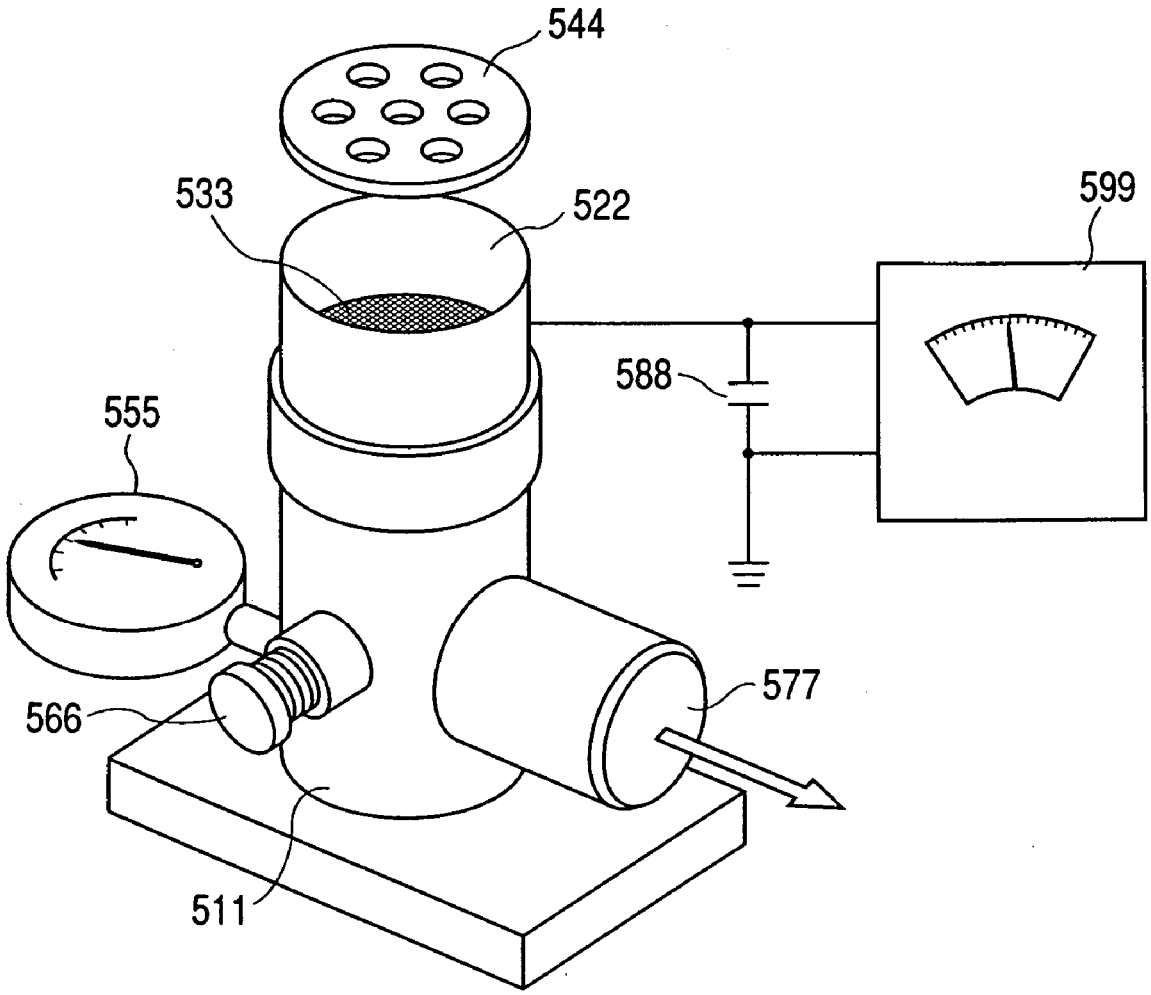
FIG. 5 illustrates an instrument used to measure triboelectric charge quantity of toners.

—Measurement of Triboelectric Charge Quantity:

Two-component triboelectric charge quantity of toner was measured by the blow-off method. First, a developer prepared by blending 7 parts of the toner and 93 parts of the acrylic-resin-coated ferrite carrier is left in a high-temperature and high-humidity environment of 30° C./80% RH for 15 hours to 20 hours. FIG. 5 illustrates an instrument for measuring two-component triboelectric charge quantity of toner. About 0.3 g of the developer thus left is put in a measuring container 522 made of a metal at the bottom of which a screen 533 of 635 meshes is provided, and the container is covered with a plate 544 made of a metal. The total weight of the measuring container 522 in this state is weighed and is expressed by $W_1$ (g). Next, in a suction device 511 (made of an insulating material at least at the part coming into contact with the measuring container 522), air is sucked from a suction opening 577 and an air-flow control valve 566 is operated to control the pressure indicated by a vacuum indicator 555 so as to be 250 mmAq. In this state, suction is carried out preferably for about 2 minutes to remove the toner by suction. The electric potential indicated by a potentiometer 599 at this stage is expressed by V (volt). In FIG. 5, reference numeral 588 denotes a capacitor, whose capacitance is expressed by C (μF). The total weight of the measuring container after the suction has been completed is also weighed and is expressed by $W_2$ (g). The triboelectric charge quantity (mC/kg) of this toner is calculated as shown by the following expression. Triboelectric charge quantity of toner $$(\text{mC/kg})=(C\times V)/(W_1-W_2)$$

—Measurement of Degree of Agglomeration of Toner:

A vibrating screen of POWDER TESTER (manufactured by Hosokawa Micron Corporation) is used. On its vibrating stand, sieves with 400 meshes (opening: 37 μm), 200 meshes (opening: 74 μm) and 100 meshes (opening: 147 μm) are so set as to be overlaid one another in the order of meshes with smaller openings, i.e., in the order of 400 mesh, 200 mesh and 100 mesh sieves so that the 100 mesh sieve is uppermost. On the 100 mesh sieve of the sieves set in this way, 5 g of a sample is placed, where the vibrational amplitude of the vibrating stand is so adjusted as to be within the range of 0.6±0.01 mm, and the sieves are vibrated for about 15 seconds. Thereafter, the weight of the sample that has remained on each sieve is measured to calculate the degree of agglomeration according to the following expression. The smaller the value of the degree of agglomeration is, the higher fluidity the toner has.

$$\begin{aligned}&\text{Degree of agglomeration (\%)} =\\&(\text{Sample weight (g) on 100 mesh sieve}/5\text{ g})\times 100 +\\&(\text{Sample weight (g) on 200 mesh sieve}/5\text{ g})\times 100\times 0.6 +\\&(\text{Sample weight (g) on 400 mesh sieve}/5\text{ g})\times 100\times 0.2\end{aligned}$$

Example 2

Toners were obtained using the toner particles shown in Table 1, Example 2, and under the same mixing conditions as those in Example 1 but according to the formulation of external additives shown in Table 1, Example 2. Thereafter, evaluation was made in the same manner as in Example 1. As the result, both at the initial stage and after 50,000-sheet printing, the toners showed good transfer performance. Physical properties of the toners are shown in Tables 3(A) and 3(B), and the results of evaluation in Table 5.

Example 3

Toners were obtained using the toner particles shown in Table 1, Example 3, of which the yellow toner particles and the cyan toner particles were put to some particle size adjustment by classification; and then under the same mixing conditions as those in Example 1 but according to the formulation of external additives shown in Table 1, Example 3. Thereafter, evaluation was made in the same manner as in Example 1. As the result, both at the initial stage and after 50,000-sheet printing, the toners showed good transfer performance. Physical properties of the toners are shown in Tables 3(A) and 3(B), and the results of evaluation in Table 5.

Example 4

Toners were obtained using the toner particles shown in Table 1, Example 4, (performing no adjustment of particle size distribution) and under the same mixing conditions as those in Example 1 but according to the formulation of external additives shown in Table 1, Example 4. Thereafter, evaluation was made in the same manner as in Example 1. As the result, both at the initial stage and after 50,000-sheet printing, the toners showed good transfer performance. Physical properties of the toners are shown in Tables 3(A) and 3(B), and the results of evaluation in Table 5.

Example 5

Toners were obtained using the toner particles shown in Table 1, Example 5, (performing no adjustment of particle size distribution) and under the same mixing conditions as those in Example 1 but according to the formulation of external additives, making use of fine silica particles not subjected to oil treatment as shown in Table 1, Example 5. Thereafter, evaluation was made in the same manner as in Example 1. As the result, both at the initial stage and after 50,000-sheet printing, the toners showed good transfer performance. Physical properties of the toners are shown in Tables 3(A) and 3(B), and the results of evaluation in Table 5.

Example 6

Evaluation was made in the same manner as in Example 1 except for using the full-color image-forming apparatus shown in FIG. 6. As the result, both at the initial stage and after 50,000-sheet printing, good images free of any spots around line images were obtained when black character images (a character "[illegible]" was used) were transferred onto yellow solid images, magenta solid images and cyan solid images.

Example 7

Evaluation was made in the same manner as in Example 1 except for using the full-color image-forming apparatus shown in FIG. 4. As the result, both at the initial stage and after 50,000-sheet printing, the toners showed good transfer performance. The results of evaluation are shown in Table 5.

Example 8

Toners were obtained using the toner particles shown in Table 1, Example 8, (performing no adjustment of particle size distribution) and under the same mixing conditions as those in Example 1 but according to the formulation of external additives shown in Table 1, Example 8. Thereafter, evaluation was made in the same manner as in Example 1. As the result, both at the initial stage and after 50,000-sheet printing, the toners showed good transfer performance. Physical properties of the toners are shown in Tables 3(A) and 3(B), and the results of evaluation in Table 5.

Comparative Example 1

Toners were obtained using the toner particles shown in Table 2, Comparative Example 1, and under the same mixing conditions as those in Example 1 but according to the formulation of external additives shown in Table 2, Comparative Example 1. Thereafter, evaluation was made in the same manner as in Example 1. As the result, the transfer current proper range was a little narrow from the beginning, and this proper range became narrower with progress of the running. Physical properties of the toners are shown in Tables 4(A) and 4(B), and the results of evaluation in Table 5.

Comparative Example 2

Toners were obtained using the toner particles shown in Table 2, Comparative Example 2, and under the same mixing conditions as those in Example 1 but according to the formulation of external additives shown in Table 2, Comparative Example 2. Thereafter, evaluation was made in the same manner as in Example 1. As the result, the transfer current proper range was a little narrow from the beginning, and this proper range became narrower with progress of the running. Also, solid black images formed had a little granular appearance. Physical properties of the toners are shown in Tables 4(A) and 4(B), and the results of evaluation in Table 5.

Comparative Example 3

Toners were obtained using the toner particles shown in Table 2, Comparative Example 3, and under the same mixing conditions as those in Example 1 but according to the formulation of external additives shown in Table 2, Comparative Example 3. Thereafter, evaluation was made in the same manner as in Example 1. As the result, the transfer current proper range became narrower with progress of the running, and coarse images were conspicuous. Physical properties of the toners are shown in Tables 4(A) and 4(B), and the results of evaluation in Table 5.

Comparative Example 4

Toners were obtained using the toner particles shown in Table 2, Comparative Example 4, and under the same mixing conditions as those in Example 1 but according to the formulation of external additives shown in Table 2, Comparative Example 4. Thereafter, evaluation was made in the same manner as in Example 1. As the result, the transfer current proper range was a little narrow from the beginning, and coarse images were conspicuous. Also, this proper range became narrower with progress of the running, and coarse images were perceived. Physical properties of the toners are shown in Tables 4(A) and 4(B), and the results of evaluation in Table 5.

Example 9

In Example 1, the image-forming apparatus used to make evaluation was so changed in mechanism that the auto-refresh developing system was applicable, and 15% by weight of a magnetic carrier was incorporated in the replenishing developers in the P-CRGs, where a 75 g/m$^2$ A4 plain paper 50,000-sheet continuous printing test was conducted in the high-temperature and high-humidity environment, using an image with a print percentage of 4% in respect to the paper area. As the result, the toners all showed good transfer performance, and also the transfer current proper range was also ascertained to be 17 μA. Further thereafter, an image with a print percentage of 1% was printed on 1,000 sheets, and then an image with a print percentage of 100% was printed on 20 sheets. Immediately thereafter, evaluation was made on each item to find that the toners all showed good transfer performance, and also the transfer current proper range was ascertained to be 17 μA.

TABLE 1

| | | Silica | Titanium | Silica |
|---|---|---|---|---|
| | | Hydrophobic treatment: | | |
| | | Hexamethyldisilazane | Hexamethyldisilazane | Hexamethyldisilazane |
| | | Oil treatment: | | |
| | | Polydimethylsiloxane | None | None |
| | | One-point BET s.s.a.: (specific surface area) | | |
| | Toners used | 80 m$^2$/g | 110 m$^2$/g | 100 m$^2$/g |
| Examples 1, 6, 7, 9: | | | | |
| Y | Production Example 1 | 0.8 part | 0.8 part | |
| M | Production Example 2 | 0.8 part | 0.8 part | |
| C | Production Example 3 | 0.8 part | 0.8 part | |
| Bk | Production Example 4 | 0.9 part | 1.0 part | |

TABLE 1-continued

| | | Silica | Titanium | Silica |
|---|---|---|---|---|
| | | Hydrophobic treatment: | | |
| | | Hexamethyldisilazane | Hexamethyldisilazane | Hexamethyldisilazane |
| | | Oil treatment: | | |
| | | Polydimethylsiloxane | None | None |
| | | One-point BET s.s.a.: (specific surface area) | | |
| | Toners used | 80 $m^2/g$ | 110 $m^2/g$ | 100 $m^2/g$ |
| Example 2: | | | | |
| Y | Production Example 5 | 0.8 part | 0.8 part | |
| M | Production Example 6 | 0.8 part | 0.8 part | |
| C | Production Example 7 | 0.8 part | 0.8 part | |
| Bk | Production Example 8 | 0.9 part | 1.0 part | |
| Example 3: | | | | |
| Y | Production Example 9 | 0.8 part | 0.8 part | |
| M | Production Example 10 | 0.8 part | 0.8 part | |
| C | Production Example 11 | 0.8 part | 0.8 part | |
| Bk | Production Example 12 | 0.9 part | 1.0 part | |
| Example 4: | | | | |
| Y | Production Example 1 | 0.8 part | 0.8 part | |
| M | Production Example 2 | 0.8 part | 0.8 part | |
| C | Production Example 3 | 0.8 part | 0.8 part | |
| Bk | Production Example 13 | 0.9 part | 1.0 part | |
| Example 5: | | | | |
| Y | Production Example 1 | | 0.8 part | 0.8 part |
| M | Production Example 2 | | 0.8 part | 0.8 part |
| C | Production Example 3 | | 0.8 part | 0.8 part |
| Bk | Production Example 4 | | 1.0 part | 0.9 part |
| Example 8: | | | | |
| Y | Production Example 1 | | 1.1 parts | |
| M | Production Example 2 | | 1.1 parts | |
| C | Production Example 3 | | 1.1 parts | |
| Bk | Production Example 4 | | 1.4 parts | |

TABLE 2

| | | Silica | Titanium | Silica |
|---|---|---|---|---|
| | | Hydrophobic treatment: | | |
| | | Hexamethyldisilazane | Hexamethyldisilazane | Hexamethyldisilazane |
| | | Oil treatment: | | |
| | | Polydimethylsiloxane | None | None |
| | | One-point BET s.s.a.: (specific surface area) | | |
| | Toners used | 80 $m^2/g$ | 110 $m^2/g$ | 100 $m^2/g$ |
| Comparative Example 1: | | | | |
| Y | Production Example 1 | 0.8 part | 0.8 part | |
| M | Production Example 2 | 0.8 part | 0.8 part | |
| C | Production Example 3 | 0.8 part | 0.8 part | |
| Bk | Production Example 14 | 0.9 part | 1.0 part | |
| Comparative Example 2: | | | | |
| Y | Production Example 1 | 0.8 part | 0.8 part | |
| M | Production Example 2 | 0.8 part | 0.8 part | |
| C | Production Example 3 | 0.8 part | 0.8 part | |
| Bk | Production Example 15 | 0.9 part | 1.0 part | |
| Comparative Example 3: | | | | |
| Y | Production Example 1 | 0.8 part | 0.8 part | |
| M | Production Example 2 | 0.8 part | 0.8 part | |
| C | Production Example 3 | 0.8 part | 0.8 part | |
| Bk | Production Example 4 | 0.9 part | 1.5 parts | |

TABLE 2-continued

| | | Silica | Titanium | Silica |
|---|---|---|---|---|
| | | Hydrophobic treatment: | | |
| | | Hexamethyldisilazane | Hexamethyldisilazane | Hexamethyldisilazane |
| | | Oil treatment: | | |
| | | Polydimethylsiloxane | None | None |
| | | One-point BET s.s.a.: (specific surface area) | | |
| | Toners used | 80 $m^2/g$ | 110 $m^2/g$ | 100 $m^2/g$ |
| Comparative Example 4: | | | | |
| Y | Production Example 1 | 0.8 part | 0.8 part | |
| M | Production Example 2 | 0.8 part | 0.8 part | |
| C | Production Example 3 | 0.8 part | 0.8 part | |
| Bk | Production Example 16 | 0.9 part | 1.0 part | |

TABLE 3(A)

| | Toners used | Weight average particle diameter (μm) | 5.04 μm or smaller particles (no. %) | 12.7 μm or larger particles (wt. %) | One = point BET s.s.a. ($m^2/g$) | Average circularity | Circularity standard deviation |
|---|---|---|---|---|---|---|---|
| Example 1: | | | | | | | |
| Y | Production Example 1 | 6.8 | 25.5 | 0.1 | 1.10 | 0.982 | 0.029 |
| M | Production Example 2 | 6.8 | 24.8 | 0.5 | 1.07 | 0.981 | 0.028 |
| C | Production Example 3 | 6.9 | 23.6 | 0.8 | 1.08 | 0.981 | 0.030 |
| Bk | Production Example 4 | 8.3 | 12.5 | 1.1 | 1.16 | 0.977 | 0.033 |
| Example 2: | | | | | | | |
| Y | Production Example 5 | 2.5 | 81.1 | 0.0 | 8.50 | 0.970 | 0.035 |
| M | Production Example 6 | 2.5 | 80.1 | 0.0 | 8.45 | 0.968 | 0.035 |
| C | Production Example 7 | 2.5 | 80.5 | 0.0 | 8.33 | 0.968 | 0.035 |
| Bk | Production Example 8 | 3.0 | 77.5 | 0.1 | 9.15 | 0.970 | 0.036 |
| Example 3: | | | | | | | |
| Y | Production Example 9 | 9.7 | 7.8 | 1.5 | 0.89 | 0.980 | 0.030 |
| M | Production Example 10 | 9.7 | 8.0 | 1.0 | 0.90 | 0.977 | 0.032 |
| C | Production Example 11 | 9.7 | 8.3 | 0.5 | 0.90 | 0.981 | 0.029 |
| Bk | Production Example 12 | 10.2 | 7.5 | 2.0 | 1.02 | 0.974 | 0.034 |
| Example 4: | | | | | | | |
| Y | Production Example 1 | 6.8 | 25.5 | 0.5 | 1.07 | 0.982 | 0.029 |
| M | Production Example 2 | 6.8 | 24.8 | 0.5 | 1.07 | 0.981 | 0.028 |
| C | Production Example 3 | 6.9 | 25.3 | 0.5 | 1.09 | 0.981 | 0.030 |
| Bk | Production Example 13 | 8.9 | 3.6 | 1.0 | 1.11 | 0.977 | 0.030 |
| Example 5: | | | | | | | |
| Y | Production Example 1 | 6.8 | 25.5 | 0.5 | 1.12 | 0.982 | 0.029 |
| M | Production Example 2 | 6.8 | 24.8 | 0.5 | 1.12 | 0.981 | 0.028 |
| C | Production Example 3 | 6.9 | 25.3 | 0.5 | 1.13 | 0.981 | 0.030 |
| Bk | Production Example 4 | 8.3 | 12.5 | 1.1 | 1.22 | 0.977 | 0.033 |
| Examples 6, 7, 9: | | | | | | | |
| Y | Production Example 1 | 6.8 | 25.5 | 0.1 | 1.07 | 0.982 | 0.029 |
| M | Production Example 2 | 6.8 | 24.8 | 0.5 | 1.07 | 0.981 | 0.028 |
| C | Production Example 3 | 6.9 | 25.3 | 0.8 | 1.09 | 0.981 | 0.030 |
| Bk | Production Example 4 | 8.3 | 12.5 | 1.1 | 1.16 | 0.977 | 0.033 |
| Example 8: | | | | | | | |
| Y | Production Example 1 | 6.8 | 25.5 | 0.5 | 0.98 | 0.982 | 0.029 |
| M | Production Example 2 | 6.8 | 24.8 | 0.5 | 0.99 | 0.981 | 0.028 |
| C | Production Example 3 | 6.9 | 25.3 | 0.5 | 0.99 | 0.981 | 0.030 |
| Bk | Production Example 4 | 8.3 | 12.5 | 1.0 | 1.18 | 0.977 | 0.033 |

TABLE 3(B)

| | Toner triboelectric charge quantity | | Toner degree of agglomeration | | | | |
|---|---|---|---|---|---|---|---|
| | Moderate temp./ moderate humidity (mC/kg) | High temp./ high humidity (mC/kg) | Moderate temp./ moderate humidity (%) | High temp./ high humidity (%) | D4c/D4b | Sc/Sb | $Uc_{5.04}/Ub_{5.04}$ |
| Example 1: | | | | | | | |
| Y | −30.5 | −26.1 | 20 | 18 | 0.819 | 0.948 | 2.04 |
| M | −30.2 | −24.1 | 17 | 15 | 0.819 | 0.922 | 1.98 |
| C | −29.6 | −25.1 | 17 | 15 | 0.831 | 0.931 | 1.89 |
| Bk | −24.4 | −22.7 | 15 | 12 | — | — | — |
| Example 2: | | | | | | | |
| Y | −39.9 | −35.9 | 18 | 15 | 0.833 | 0.929 | 1.05 |
| M | −39.8 | −33.2 | 16 | 14 | 0.833 | 0.923 | 1.03 |
| C | −39.6 | −32.8 | 16 | 14 | 0.833 | 0.910 | 1.04 |
| Bk | −36.4 | −31.4 | 12 | 11 | — | — | — |
| Example 3: | | | | | | | |
| Y | −28.5 | −24.6 | 20 | 18 | 0.951 | 0.873 | 1.04 |
| M | −27.0 | −22.0 | 16 | 14 | 0.951 | 0.882 | 1.07 |
| C | −27.6 | −22.4 | 15 | 14 | 0.951 | 0.882 | 1.11 |
| Bk | −24.4 | −19.8 | 14 | 12 | — | — | — |
| Example 4: | | | | | | | |
| Y | −31.1 | −26.1 | 20 | 18 | 0.764 | 0.964 | 7.08 |
| M | −29.9 | −24.1 | 17 | 15 | 0.764 | 0.964 | 6.89 |
| C | −29.9 | −25.1 | 17 | 15 | 0.775 | 0.982 | 7.03 |
| Bk | −24.1 | −19.7 | 14 | 11 | — | — | — |
| Example 5: | | | | | | | |
| Y | −31.2 | −25.8 | 20 | 17 | 0.819 | 0.918 | 2.04 |
| M | −30.2 | −24.0 | 17 | 14 | 0.819 | 0.918 | 1.98 |
| C | −29.9 | −23.8 | 17 | 15 | 0.831 | 0.926 | 2.02 |
| Bk | −26.2 | −20.1 | 14 | 11 | — | — | — |
| Examples 6, 7, 9: | | | | | | | |
| Y | −30.5 | −26.1 | 20 | 18 | 0.819 | 0.922 | 2.04 |
| M | −30.2 | −24.1 | 17 | 15 | 0.819 | 0.922 | 1.98 |
| C | −29.6 | −25.1 | 17 | 15 | 0.831 | 0.940 | 2.02 |
| Bk | −24.4 | −22.7 | 15 | 12 | — | — | — |
| Example 8: | | | | | | | |
| Y | −29.0 | −22.4 | 15 | 14 | 0.819 | 0.831 | 2.04 |
| M | −27.8 | −20.5 | 14 | 11 | 0.819 | 0.839 | 1.98 |
| C | −27.8 | −20.3 | 13 | 12 | 0.831 | 0.839 | 2.02 |
| Bk | −25.0 | −17.7 | 7 | 6 | — | — | — |

TABLE 4(A)

| | Toners used | Weight average particle diameter (μm) | 5.04 μm or smaller particles (no. %) | 12.7 μm or larger particles (wt. %) | One = point BET s.s.a. ($m^2/g$) | Average circularity | Circularity standard deviation |
|---|---|---|---|---|---|---|---|
| Comparative Example 1: | | | | | | | |
| Y | Production Example 1 | 6.8 | 25.5 | 0.5 | 1.07 | 0.982 | 0.029 |
| M | Production Example 2 | 6.8 | 24.8 | 0.5 | 1.07 | 0.981 | 0.028 |
| C | Production Example 3 | 6.9 | 25.3 | 0.5 | 1.09 | 0.981 | 0.030 |
| Bk | Production Example 14 | 6.9 | 27.0 | 0.5 | 1.13 | 0.978 | 0.033 |

TABLE 4(A)-continued

| | Toners used | Weight average particle diameter (μm) | 5.04 μm or smaller particles (no. %) | 12.7 μm or larger particles (wt. %) | One = point BET s.s.a. ($m^2/g$) | Average circularity | Circularity standard deviation |
|---|---|---|---|---|---|---|---|
| Comparative Example 2: | | | | | | | |
| Y | Production Example 1 | 6.8 | 25.5 | 0.5 | 1.07 | 0.982 | 0.029 |
| M | Production Example 2 | 6.8 | 24.8 | 0.5 | 1.07 | 0.981 | 0.028 |
| C | Production Example 3 | 6.9 | 25.3 | 0.5 | 1.09 | 0.981 | 0.030 |
| Bk | Production Example 15 | 12.1 | 6.7 | 48.3 | 0.68 | 0.970 | 0.036 |
| Comparative Example 3: | | | | | | | |
| Y | Production Example 1 | 6.8 | 25.5 | 0.5 | 1.07 | 0.982 | 0.029 |
| M | Production Example 2 | 6.8 | 24.8 | 0.5 | 1.07 | 0.981 | 0.028 |
| C | Production Example 3 | 6.9 | 25.3 | 0.5 | 1.09 | 0.981 | 0.030 |
| Bk | Production Example 4 | 8.3 | 12.5 | 1.1 | 1.80 | 0.977 | 0.033 |
| Comparative Example 4: | | | | | | | |
| Y | Production Example 1 | 6.8 | 25.5 | 0.5 | 1.07 | 0.982 | 0.029 |
| M | Production Example 2 | 6.8 | 24.8 | 0.5 | 1.07 | 0.981 | 0.028 |
| C | Production Example 3 | 6.9 | 25.3 | 0.5 | 1.09 | 0.981 | 0.030 |
| Bk | Production Example 16 | 8.5 | 15.6 | 2.5 | 1.23 | 0.930 | 0.059 |

TABLE 4(B)

| | Toner triboelectric charge quantity | | Toner degree of agglomeration | | | | |
|---|---|---|---|---|---|---|---|
| | Moderate temp./ moderate humidity (mC/kg) | High temp./ high humidity (mC/kg) | Moderate temp./ moderate humidity (%) | High temp./ high humidity (%) | D4c/D4b | Sc/Sb | $Uc_{5.04}/Ub_{5.04}$ |
| Comparative Example 1: | | | | | | | |
| Y | −33.5 | −26.1 | 22 | 18 | 0.986 | 0.947 | 0.94 |
| M | −30.0 | −24.1 | 20 | 15 | 0.986 | 0.947 | 0.92 |
| C | −30.5 | −25.1 | 20 | 15 | 1.000 | 0.965 | 0.94 |
| Bk | −26.6 | −23.3 | 16 | 12 | — | — | — |
| Comparative Example 2: | | | | | | | |
| Y | −33.5 | −26.1 | 22 | 18 | 0.562 | 1.574 | 3.81 |
| M | −30.0 | −24.1 | 20 | 15 | 0.562 | 0.574 | 3.70 |
| C | −30.5 | −25.1 | 20 | 15 | 0.570 | 1.603 | 3.78 |
| Bk | −25.0 | −17.1 | 16 | 13 | — | — | — |
| Comparative Example 3: | | | | | | | |
| Y | −33.5 | −26.1 | 22 | 18 | 0.819 | 0.594 | 20.4 |
| M | −30.0 | −24.1 | 20 | 15 | 0.819 | 0.594 | 1.98 |
| C | −30.5 | −25.1 | 20 | 15 | 0.831 | 0.606 | 2.02 |
| Bk | −25.6 | −20.5 | 8 | 6 | — | — | — |
| Comparative Example 4: | | | | | | | |
| Y | −33.5 | −26.1 | 22 | 18 | 0.800 | 0.870 | 1.63 |
| M | −30.0 | −24.1 | 20 | 15 | 0.800 | 0.870 | 1.59 |
| C | −30.5 | −25.1 | 20 | 15 | 0.812 | 0.886 | 1.62 |
| Bk | −25.8 | −21.0 | 11 | 10 | — | — | — |

TABLE 5

| | Initial stage | | | 50,000th sheet | | |
|---|---|---|---|---|---|---|
| | Transfer performance to cardboard | Diff. bet. 1st-side printing & 2nd-side printing in double-side printing | Transfer current proper range between color toners & black toner (Y/M/C, μA) | Transfer performance to cardboard | Diff. bet. 1st-side printing & 2nd-side printing in double-side printing | Transfer current proper range between color toners & black toner (Y/M/C, μA) |
| Example 1: | | | | | | |
| M/M | A | A | 18.0/18.0/18.0 | A | A | 17.0/16.0/15.0 |
| H/H | A | A | 17.0/17.0/17.0 | A | A | 15.0/13.0/12.0 |
| Example 2: | | | | | | |
| M/M | A | A | 13.0/13.0/13.0 | A | A | 12.0/12.0/12.0 |
| H/H | A | A | 12.0/12.0/12.0 | B | A | 10.0/10.0/10.0 |
| Example 3: | | | | | | |
| M/M | A | A | 13.0/13.0/13.0 | A | A | 9.0/10.0/12.0 |
| H/H | A | A | 13.0/13.0/13.0 | B | A | 7.0/8.5/10.0 |
| Example 4: | | | | | | |
| M/M | A | A | 13.0/13.0/13.0 | A | A | 11.0/11.0/11.0 |
| H/H | A | A | 10.0/10.0/10.0 | A | A | 8.0/8.0/8.0 |
| Example 5: | | | | | | |
| M/M | A | A | 17.0/17.0/17.0 | B | A | 14.0/14.0/14.0 |
| H/H | A | A | 16.0/16.0/16.0 | B | B | 12.0/12.0/12.0 |
| Example 7: | | | | | | |
| M/M | A | A | 18.0/18.0/18.0 | A | A | 17.0/17.0/17.0 |
| H/H | A | A | 17.0/17.0/17.0 | A | A | 15.0/15.0/15.0 |
| Example 8: | | | | | | |
| M/M | B | A | 13.0/13.0/13.0 | B | A | 8.5/8.5/8.5 |
| H/H | B | A | 10.0/10.0/10.0 | B | B | 7.0/7.0/7.0 |
| Comparative Example 1: | | | | | | |
| M/M | A | A | 11.0/11.0/11.0 | A | A | 9.5/9.5/9.5 |
| H/H | A | A | 9.5/9.5/9.5 | B | B | 5.5/5.5/5.5 |
| Comparative Example 2: | | | | | | |
| M/M | B | B | 9.0/9.0/9.0 | B | A | 8.0/8.0/8.0 |
| H/H | C | B | 4.0/4.0/4.0 | D | D | 2.5/2.5/2.5 |
| Comparative Example 3: | | | | | | |
| M/M | A | A | 7.5/7.5/7.5 | A | A | 5.5/5.5/5.5 |
| H/H | B | B | 7.0/7.0/7.0 | C | C | 2.5/2.5/2.5 |
| Comparative Example 4: | | | | | | |
| M/M | C | B | 5.0/5.0/5.0 | D | A | 4.0/4.0/4.0 |
| H/H | C | C | 2.0/2.0/2.0 | D | D | 1.5/1.5/1.5 |

M/M: Moderate temperature/moderate humidity
H/H: High temperature/high humidity

What is claimed is:

1. A toner kit comprising a non-magnetic black toner having at least carbon black, and at least three color toners, wherein said black toner has a weight-average particle diameter represented by D4*b* and a one-point method BET specific surface area represented by Sb, and the color toners, other than the black toner, each having a weight-average particle diameter represented by D4*c* and a one-point method BET specific surface area represented by Sc, wherein said black toner and color tenors satisfy the following relations (1) and (2):

$$0.60 \leqq D4c/D4b \leqq 0.96, \quad \text{Relation (1):}$$

$$0.750 Sc/Sb\ 1.000, \quad \text{Relation (2):}$$

and each have an average circularity of from 0.095 to 1.000 and a circularity standard deviation of less than 0.040 as measured with a flow type particle image analyzer.

2. The toner kit according to claim 1, wherein said black toner has a weight-average particle diameter D4*b* of from 3.2 μm to 10 μm, and said color toners each have a weight-average particle diameter D4*c* of from 3.0 μm to 9.6 μm.

3. The toner kit according to claim 1, wherein said black toner and color toners each contain at least inorganic fine particles.

4. The toner kit according to claim 3, wherein said inorganic fine particles comprises fine silica particles.

5. The toner kit according to claim 4, wherein said fine silica particles are subjected to at least oil treatment.

6. The toner kit according to claim 1, wherein said black toner and color toners each contain at least two kinds of inorganic fine particles having different BET specific surface areas.

7. The toner kit according to claim 3, wherein the proportion of the inorganic fine particles contained in said black toner is larger than the proportion of the inorganic fine particles contained in said color toners.

8. The toner kit according to claim 1, wherein said color toners comprise a yellow toner, a magenta toner and a cyan toner, and all of these satisfy the relations (1) and (2).

9. A color image-forming method comprising:

a charging step of electrostatioslly charging an electrostatic-latent-image-bearing member for holding thereon an electrostatic latent image;

an electrostatic latent image formation step of forming the electrostatic latent image on the electrostatic-latent-image-bearing member thus charged;

a developing step of developing the electrostatic latent image by the use of a toner a developing means has, to form a toner image;

a transfer step of transferring the toner image held on the electrostatic-latent-image-bearing member, to a transfer material via, or not via, an intermediate transfer member; and a fixing step of firing by fixing means the toner image held on the transfer material, wherein i) a non-magnetic black toner has at least carbon black and ii) at least three color toners each being used as the toner, wherein said black toner has a weight-average particle diameter represented by D4*b* and a one-point method BET specific surface area represented by Sb, and said color toners, other than the black toner, each having a weight-average particle diameter represented by D4*c* and a one-point method BET specific surface area represented by Sc, wherein said black toner and color toners satisfy the following relations (1) and (2):

$$0.60 \leqq D4c/D4b \leqq 0.96. \quad \text{Relation (1):}$$

$$0.750 \leqq Sc/Sb \leqq 1.000,$$

and each have an average circularity of from 0.950 to 1.000 and a circularity standard deviation of less than 0.040 as measured with a flow type particle image analyzer.

10. The color image-forming method according to claim 9, wherein said black toner and color toners each contain at least inorganic fine particles.

11. The color image-forming method according to claim 10, wherein said inorganic fine particles comprises fine silica particles.

12. The color image-forming method according to claim 11, wherein said fine silica particles are subjected to at least oil treatment.

13. The color image-forming method according to claim 9, wherein said black toner and color toners each contain at least two kinds of inorganic fine particles having different BET specific surface areas.

14. The color image-forming method according to claim 10, wherein the proportion of the inorganic fine particles contained in said black toner is larger than the proportion of the inorganic fine particles contained in said color toners.

15. The color image-forming method according to claim 9, wherein said color toners comprise a yellow toner, a magenta toner and a cyan toner, and all of these satisfy the relations (1) and (2).

16. The color image-forming method according to claim 9, which is a color image-forming method comprising:

forming a black toner image by means of a black-image-forming unit having at least an electrostatic-latent-image-bearing member, a charging means, a developing means and a toner-holding means; and forming color toner images by means of color-image-forming units each having at least an electrostatic-latent-image-bearing member, a charging means, a developing means and a toner-holding means, wherein said black-image-forming unit and color-image-forming units are disposed in a tandem form.

17. The color image-forming method according to claim 9, wherein said color-image-forming units comprise a yellow-image-forming unit, a magenta-image-forming unit, and a cyan-image-forming unit;

said yellow-image-forming unit having at least the electrostatic-latent-image-bearing member, the charging means the developing means, and the toner-holding means to form a yellow toner image;

said magenta-image-forming unit having at least the electrostatic-latent-image-bearing member, the charging means, the developing means and the toner-holding means to form a magenta toner image; and said cyan-image-forming unit having at least the electrostatic-latent-image-bearing member, the charging means, the developing means and the toner-holding means to form a cyan toner image; and said black-image-forming unit, yellow-image-forming unit, magenta-image-forming unit and cyan-image-forming unit being disposed in the tandem form.

18. The color image-forming method according to claim 9, wherein said developing step serves also as the collection of a transter residual toner.

19. The color image-forming method according to claim 9, wherein said developing step is of a two-component developing system which performs development making use of a two-component developer containing a non-magnetic toner and a magnetic carrier.

20. The color image-forming method according to claim 9, wherein said developing step is of a two-component developing system which performs development making use of a two-component developer containing a non-magnetic toner and a magnetic carrier, and wherein as the developing system an auto-refresh developing system is used in which images are formed successively collecting the magnetic carrier and replenishing a replenishing developer containing a non-magnetic toner and a magnetic carrier.

* * * * *

UNITED STATES PATENT AND TRADEMARK OFFICE

CERTIFICATE OF CORRECTION

PATENT NO. : 7,132,207 B2
APPLICATION NO. : 11/303678
DATED : November 7, 2006
INVENTOR(S) : Katsuyuki Nonaka et al.

It is certified that error appears in the above-identified patent and that said Letters Patent is hereby corrected as shown below:

In the Claims:

Column 38, line 62, Relation (2) "0.750Sc/Sb 1.000" should read --$0.750 \leq Sc/Sb \leq 1.000$--.

Signed and Sealed this
Twenty-seventh Day of August, 2013

Teresa Stanek Rea
*Acting Director of the United States Patent and Trademark Office*